US007809288B2

(12) United States Patent
Okano

(10) Patent No.: US 7,809,288 B2
(45) Date of Patent: Oct. 5, 2010

(54) COLOR IMAGE FORMING DEVICE UTILIZING TONER SENSORS TO DETECT WITHDRAWAL AMOUNT OF DRAWER SECTION

(75) Inventor: Tetsuya Okano, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 886 days.

(21) Appl. No.: 11/639,295

(22) Filed: Dec. 15, 2006

(65) Prior Publication Data

US 2007/0140710 A1 Jun. 21, 2007

(30) Foreign Application Priority Data

Dec. 20, 2005 (JP) ..... P2005-366531

(51) Int. Cl.
*G03G 15/00* (2006.01)

(52) U.S. Cl. ..... 399/13; 399/27; 399/28; 399/119

(58) Field of Classification Search ..... 399/13, 399/27, 119, 28
See application file for complete search history.

(56) References Cited

U.S. PATENT DOCUMENTS

2003/0053819 A1* 3/2003 Nomura et al. ..... 399/110
2004/0264984 A1 12/2004 Yabuki et al.

FOREIGN PATENT DOCUMENTS

| | | |
|---|---|---|
| JP | 6-317958 | 11/1994 |
| JP | 7-306582 | 11/1995 |
| JP | 2001-175131 | 6/2001 |
| JP | 2002-221843 | 8/2002 |
| JP | 2004-309999 | 11/2004 |

* cited by examiner

*Primary Examiner*—David P Porta
*Assistant Examiner*—Bryan P Ready
(74) *Attorney, Agent, or Firm*—Banner & Witcoff, Ltd.

(57) ABSTRACT

In a color laser printer, four toner cartridges are juxtaposed in a straight line in a process unit. When the process unit is withdrawn from the laser printer to a position at which the toner cartridge nearest the front of the laser printer can be removed, an out-of-toner sensor farthest from the front of the laser printer from among four out-of-toner sensors turns on. Side surfaces of a unit-accommodating section constituting the process unit block detection light from the other three out-of-toner sensors so that these out-of-toner sensors remain off. Since the farthest out-of-toner sensor switches from off to on, the CPU determines that the process unit has been withdrawn to a position at which the nearest toner cartridge can be removed.

10 Claims, 21 Drawing Sheets

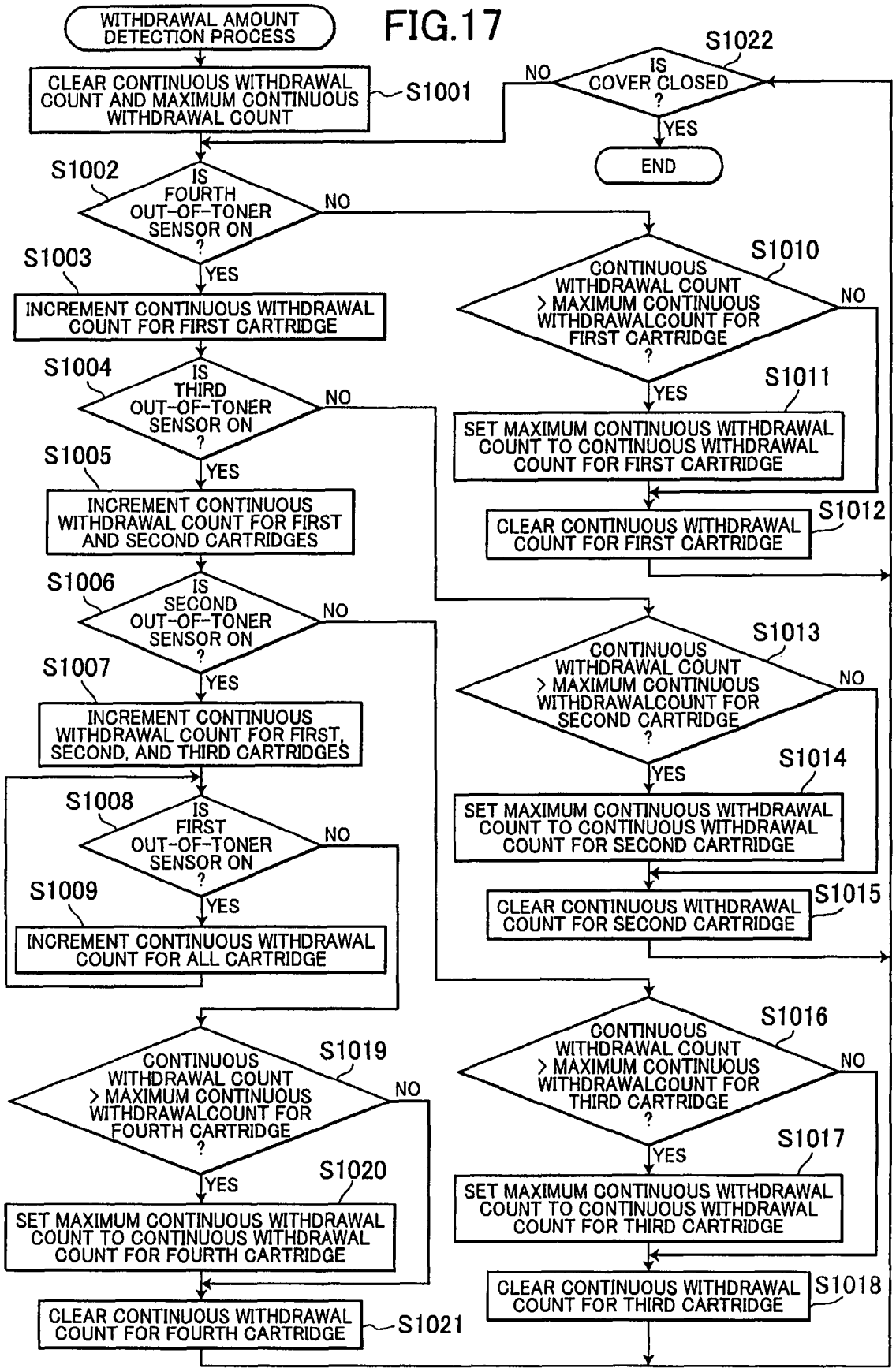
FIG.17
WITHDRAWAL AMOUNT DETECTION PROCESS
CLEAR CONTINUOUS WITHDRAWAL COUNT AND MAXIMUM CONTINUOUS WITHDRAWAL COUNT
S1001
S1002
IS FOURTH OUT-OF-TONER SENSOR ON ?
NO
YES
S1003
INCREMENT CONTINUOUS WITHDRAWAL COUNT FOR FIRST CARTRIDGE
S1004
IS THIRD OUT-OF-TONER SENSOR ON ?
NO
YES
S1005
INCREMENT CONTINUOUS WITHDRAWAL COUNT FOR FIRST AND SECOND CARTRIDGES
S1006
IS SECOND OUT-OF-TONER SENSOR ON ?
NO
YES
S1007
INCREMENT CONTINUOUS WITHDRAWAL COUNT FOR FIRST, SECOND, AND THIRD CARTRIDGES
S1008
IS FIRST OUT-OF-TONER SENSOR ON ?
NO
YES
S1009
INCREMENT CONTINUOUS WITHDRAWAL COUNT FOR ALL CARTRIDGE
S1019
CONTINUOUS WITHDRAWAL COUNT > MAXIMUM CONTINUOUS WITHDRAWALCOUNT FOR FOURTH CARTRIDGE ?
NO
YES
S1020
SET MAXIMUM CONTINUOUS WITHDRAWAL COUNT TO CONTINUOUS WITHDRAWAL COUNT FOR FOURTH CARTRIDGE
CLEAR CONTINUOUS WITHDRAWAL COUNT FOR FOURTH CARTRIDGE
S1021
S1022
IS COVER CLOSED ?
NO
YES
END
S1010
CONTINUOUS WITHDRAWAL COUNT > MAXIMUM CONTINUOUS WITHDRAWALCOUNT FOR FIRST CARTRIDGE ?
NO
YES
S1011
SET MAXIMUM CONTINUOUS WITHDRAWAL COUNT TO CONTINUOUS WITHDRAWAL COUNT FOR FIRST CARTRIDGE
CLEAR CONTINUOUS WITHDRAWAL COUNT FOR FIRST CARTRIDGE
S1012
S1013
CONTINUOUS WITHDRAWAL COUNT > MAXIMUM CONTINUOUS WITHDRAWALCOUNT FOR SECOND CARTRIDGE ?
NO
YES
S1014
SET MAXIMUM CONTINUOUS WITHDRAWAL COUNT TO CONTINUOUS WITHDRAWAL COUNT FOR SECOND CARTRIDGE
CLEAR CONTINUOUS WITHDRAWAL COUNT FOR SECOND CARTRIDGE
S1015
S1016
CONTINUOUS WITHDRAWAL COUNT > MAXIMUM CONTINUOUS WITHDRAWALCOUNT FOR THIRD CARTRIDGE ?
NO
YES
S1017
SET MAXIMUM CONTINUOUS WITHDRAWAL COUNT TO CONTINUOUS WITHDRAWAL COUNT FOR THIRD CARTRIDGE
CLEAR CONTINUOUS WITHDRAWAL COUNT FOR THIRD CARTRIDGE
S1018

COLOR IMAGE FORMING DEVICE UTILIZING TONER SENSORS TO DETECT WITHDRAWAL AMOUNT OF DRAWER SECTION

CROSS REFERENCE TO RELATED APPLICATION

This application claims priority from Japanese Patent Application No. 2005-366531 filed Dec. 20, 2005. The entire content of this priority application is incorporated herein by reference.

TECHNICAL FIELD

The disclosure relates to an image-forming device, such as a laser printer, and particularly to a color image-forming device capable of forming color images.

BACKGROUND

Image-forming devices, such as laser printers, that are well known in the art have been conventionally provided with a toner sensor for detecting the amount of residual toner in a toner cartridge mounted in the image-forming devices.

For example, a monochromatic image-forming device disclosed in Japanese unexamined patent application publication No. HEI-7-306582 includes a toner sensor having a light-emitting unit for emitting light into a toner cartridge and a light-receiving unit for receiving the light passed through the toner cartridge. The image-forming device detects changes in the light received by the light-receiving unit as an agitator agitates toner in the toner cartridge, thereby detecting the remaining amount of toner. In this monochromatic image-forming device, it is also determined whether or not the toner cartridge is being mounted in a main casing based on whether light emitted by the light-emitting unit was blocked by the side surface of the toner cartridge.

Since this image-forming device uses the toner sensor instead of a dedicated sensor for detecting the presence of the toner cartridge, this technology simplifies the assembly of the image forming device and reduces manufacturing costs.

In recent years, color image-forming devices capable of forming color images on paper have become widespread in use. These image-forming devices are provided with four toner cartridges, each filled with toner of a different color. One color image-forming device well known in the art is provided with a drawer section that can be pulled out of a main casing of the image-forming device and that accommodates the four toner cartridges mounted in a linear juxtaposed relationship. This color image-forming device can detect when the four toner cartridges have been pulled out of the main casing by providing a single sensor dedicated to detecting the presence of the toner cartridges or by employing one of the toner sensors as a sensor for detecting the presence of the toner cartridges.

However, with a color image-forming device having this construction, there may be cases in which a toner cartridge positioned nearest the operator in the direction for pulling the toner cartridges out of the main casing runs out of toner and needs to be replaced. In this case, the operator may simply pull out the drawer section a sufficient distance to replace the nearest toner cartridge and subsequently reinsert the drawer section into the main casing. In such a case, the sensor provided to detect the presence of the toner cartridges detects that the four toner cartridges have not been withdrawn from the main casing. Accordingly, a message for prompting a user to replace the toner cartridge remains displayed on a display panel provided to the image forming device, even though the toner cartridge has been replaced.

SUMMARY

In view of the foregoing, it is an object of the invention to provide a color image-forming device that can be manufactured at a low cost and that is capable of detecting a distance that a drawer section in which a plurality of toner cartridges is mounted is withdrawn.

In order to attain the above and other objects, the invention provides a color image-forming device including: a plurality of developer cartridges, each accommodating developer and having a pair of windows; a drawer section that accommodates the developer cartridges in a linearly juxtaposed relationship; a casing that accommodates the drawer section, wherein the drawer section is capable of being withdrawn from the casing in a direction that the developer cartridges are juxtaposed; a plurality of sensors that corresponds to the plurality of developer cartridges, each of the sensors having a light-emitting unit that emits a light and a light-receiving unit that receives the light emitted from the light-emitting unit, the light-emitting unit and the light-receiving unit being disposed one on either side of the windows of a corresponding one of the developer cartridges accommodated in the drawer section when the drawer section is accommodated in the casing; a toner-amount detecting unit that detects the amount of developer remaining in each of the developer cartridges based on detection results of the sensors; and a withdrawal-amount determining unit that determines a withdrawal amount in which the drawer section was withdrawn from the casing based on detection results of the sensors.

BRIEF DESCRIPTION OF THE DRAWINGS

Illustrative aspects in accordance with the invention will be described in detail with reference to the following figures wherein:

FIG. 8(*b*) is a horizontal cross-sectional view conceptually showing the laser printer as the process unit is withdrawn from the main casing to a position at which a first toner cartridge can be removed;

FIG. 8(*c*) is a horizontal cross-sectional view conceptually showing the laser printer as the process unit is withdrawn from the main casing to a position at which first and second toner cartridges can be removed;

FIG. 8(*d*) is a horizontal cross-sectional view conceptually showing the laser printer as the process unit is withdrawn from the main casing to a position at which first to third toner cartridges can be removed;

FIG. 8(*e*) is a horizontal cross-sectional view conceptually showing the laser printer as the process unit is withdrawn from the main casing to a position at which first to fourth toner cartridges can be removed;

FIG. 9(*b*) is a horizontal cross-sectional view conceptually showing the laser printer as the process unit is inserted into the main casing deeper than a second out-of-toner sensor;

FIG. 9(*c*) is a horizontal cross-sectional view conceptually showing the laser printer as the process unit is inserted into the main casing deeper than a third out-of-toner sensor;

FIG. 9(*d*) is a horizontal cross-sectional view conceptually showing the laser printer as the process unit is inserted into the main casing deeper than a fourth out-of-toner sensor;

FIG. 17 is a flowchart representing a withdrawal amount detection process;

DETAILED DESCRIPTION

Figure 1:
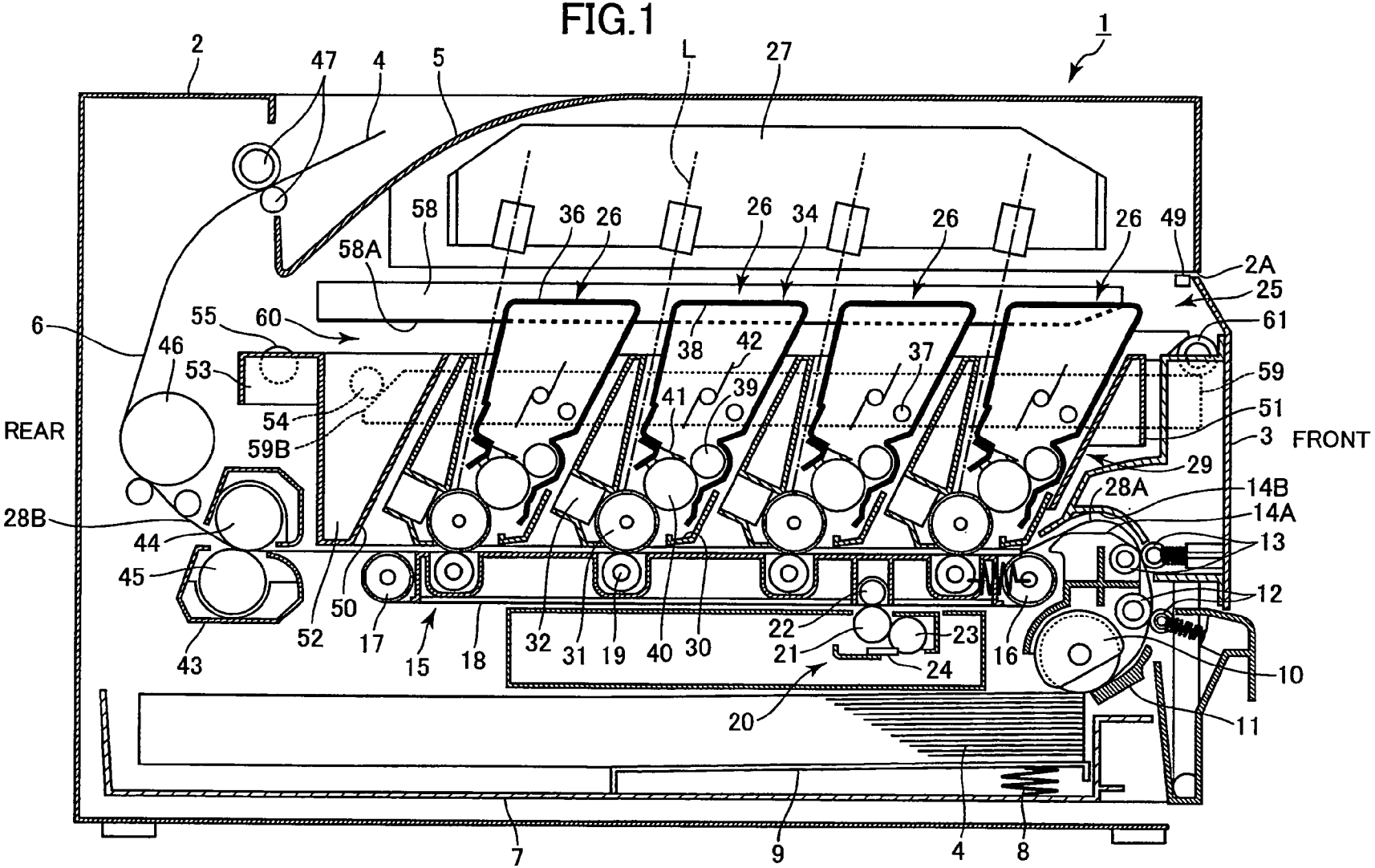
FIG. 1 is a side cross-sectional view showing the general structure of a laser printer according to illustrative aspects of the invention.

A color image-forming device according to some aspects of the invention will be described while referring to the accompanying drawings wherein like parts and components are designated by the same reference numerals to avoid duplicating description.

First, the overall configuration of a laser printer 1 as a color image-forming device according to some aspects of the invention will be described with reference to FIGS. 1 to 3.

Note that in the following description, the expressions "front", "rear", "left", "right", "above", and "below" are used to define the various parts when the laser printer 1 is disposed in an orientation in which it is intended to be used.

The laser printer 1 shown in FIG. 1 is a color laser printer having a direct transfer tandem system. As shown in FIG. 1, the laser printer 1 includes a box-shaped main casing 2 formed with an access opening 2A in the front surface thereof. A front cover 3 is attached to the main casing 2 for covering and exposing the access opening 2A. By opening the front cover 3, it is possible to replace (remove and mount) a process unit 25 and a belt unit 15 in the main casing 2 or to remove paper 4 that has become jammed inside the main casing 2.

Within the main casing 2, a sheet conveying path 6 along which sheets of paper P are conveyed is defined. A discharge tray 5 is formed on the top of the main casing 2 for supporting a stack of sheets of paper 4 that have been formed with images.

A cover open sensor 49 (FIG. 4) is provided on the main casing 2 to the inner side of the front cover 3 for detecting the opening and closing of the front cover 3 The cover open sensor 49 is a mechanical sensor for detecting the front cover 3 when the front cover 3 directly contacts a pivotable detection member of the cover open sensor 49. The cover open sensor 49 turns OFF when the front cover 3 is closed and turns ON when the front cover 3 is opened.

A sheet supply cassette 7 is disposed in the lower section of the main casing 2. The sheet supply cassette 7 can be detached from the main casing 2 by being pulled toward the front.

A pressing plate 9 is disposed inside the sheet supply cassette 7 for supporting a stack of sheets of paper 4. The pressing plate 9 is pivotable to lift up the front end of the paper 4 due to urging force of a spring 8. A pickup roller 10 and a separating pad 11 are disposed above a front end of the sheet supply cassette 7. A spring (not shown) urges the separating pad 11 against the pickup roller 10.

A pair of sheet supply rollers 12 is disposed diagonally above and frontward of the pickup roller 10. A pair of registration rollers 13 and a pair of guide members 14A and 14B are disposed above the pair of sheet supply rollers 12.

The belt unit 15 is disposed beneath the process unit 25 so as to be detachable from the main casing 2. The belt unit 15 includes a pair of support rollers 16 and 17 separated from each other in the front-to-rear direction, and a conveying belt 18 looped around the support rollers 16 and 17 so as to extend horizontally.

The conveying belt 18 is an endless belt formed of a synthetic resin material, such as polycarbonate. When the support roller 17 is driven to rotate, the conveying belt 18 moves circuitously in a counterclockwise direction in FIG. 1 for conveying a sheet of the paper 4 resting on the top surface of the conveying belt 18 rearward. Four transfer rollers 19 are arranged at regular intervals in the front-to-rear direction inside the conveying belt 18 and are positioned opposite each of photosensitive drums 31 described later so that the conveying belt 18 is interposed between the transfer rollers 19 and the respective photosensitive drums 31. During a transfer operation, a transfer bias is applied between the transfer rollers 19 and the photosensitive drums 31.

A cleaning unit 20 is disposed below the belt unit 15 for removing toner, paper dust, and the like clinging to the conveying belt 18. A cleaning roller 21 of the cleaning unit 20 includes a metal shaft coated with a foamed material made of silicon, and is in confrontation with the backup roller 22 with the conveying belt 18 interposed therebetween.

A prescribed bias is applied between the cleaning roller 21 and the backup roller 22 for electrically attracting toner and the like carried on the surface of the conveying belt 18 toward the cleaning roller 21. A metal collecting roller 23 is disposed in contact with the cleaning roller 21 for removing toner and the like deposited on the surface of the cleaning roller 21. Further, a blade 24 is disposed in contact with the collecting roller 23 for scraping off toner and the like carried on the surface of the collecting roller 23

A scanner unit 27 is disposed in the upper section of the main casing 2 and emits laser lights L for respective colors based on prescribed image data. The laser lights L irradiate, in a high speed scanning operation, the surfaces of corresponding photosensitive drums 31 to be described later.

The process unit 25 is disposed below the scanner unit 27 and inward of the access opening 2A. The process unit 25 includes four image-forming units 26, each corresponding to toner for one of four colors magenta, yellow, cyan, and black. The image-forming units 26 are aligned in the front-to-rear direction. Each image-forming unit 26 includes the photosensitive drum 31, a Scorotron charger 32, a toner cartridge 34, and the like.

The process unit 25 also includes a frame 29 that has four cartridge frames 30 arranged in the front-to-rear direction. Each cartridge frame 30 is open on the top and bottom and functions to receive the corresponding developing cartridge 34 mounted therein. The photosensitive drum 31 is retained at a position on the lower edge of the cartridge frame 30, and the charger 32 is retained adjacent to the photosensitive drum 31.

The photosensitive drum 31 includes a metal main drum that is grounded. The surface of the main drum is coated with a positively charging photosensitive layer formed of polycarbonate or the like.

The charger 32 is disposed in confrontation with the photosensitive drum 31 at a position diagonally above and rearward of the photosensitive drum 31. The charger 32 is spaced away from the photosensitive drum 31 so as to avoid direct contact with the photosensitive drum 31. The charger 32 generates a corona discharge from a charging wire, such as a tungsten wire, for example, thereby applying a uniform charge of positive polarity across the entire surface of the photosensitive drum 31.

Figure 2:
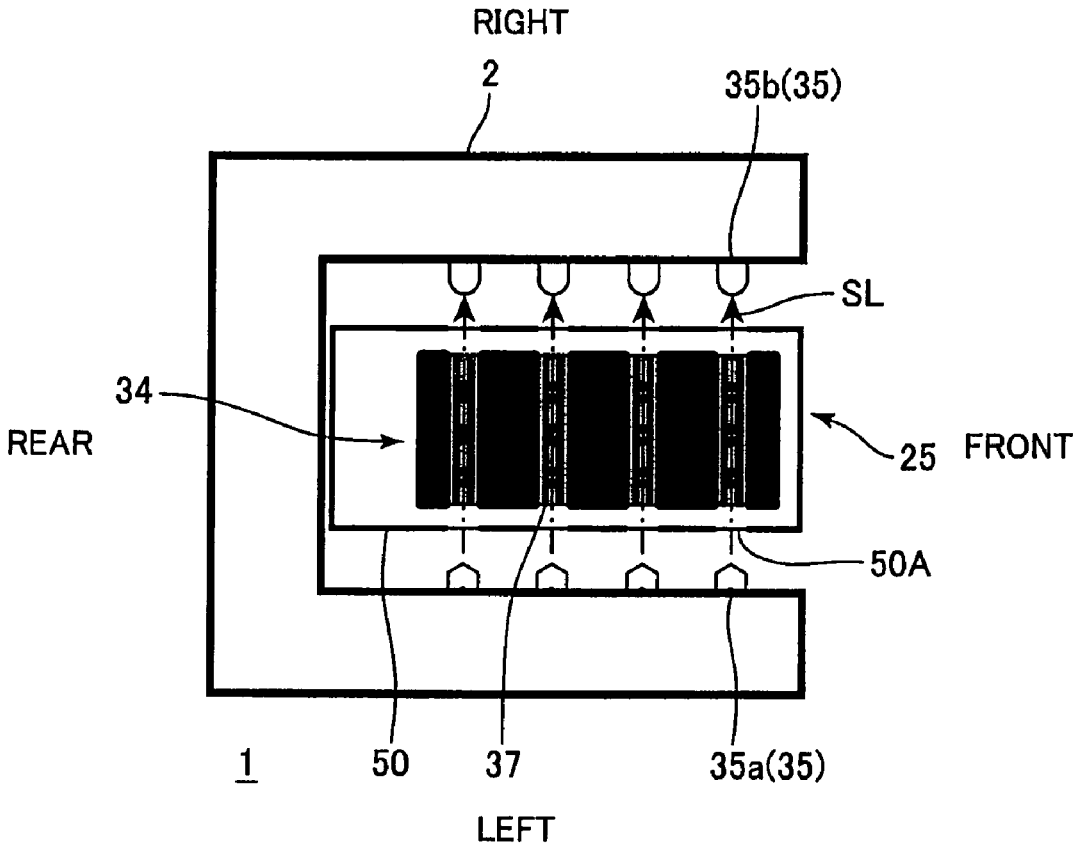
FIG. 2 is a conceptual horizontal cross-sectional view of the laser printer shown in FIG. 1.

As shown in FIGS. 1 and 2, each of the toner cartridges 34 includes a cartridge case 36 that is substantially box-shaped on the outside. Detection windows 37 are provided to the left and right side surfaces of the cartridge case 36 to confront each other.

A toner accommodating chamber 38 is formed in the upper section of each of the toner cartridges 34. The toner accommodating chamber 38 is filled with positive charging non-magnetic, single component toner for corresponding one of four colors yellow, magenta, cyan, and black. An agitator 42 for agitating the toner is disposed inside the toner accommodating chamber 38. The toner cartridge 34 further includes a supply roller 39, a developing roller 40, and a thickness regulating blade 41, all disposed below the toner accommodating chamber 38.

The supply roller 39 includes a metal roller shaft covered with a conductive foam material, and the developing roller 40 includes a metal roller shaft coated with a conductive rubber material.

As shown in FIG. 2, the laser printer 1 further includes four out-of-toner sensors 35 corresponding to the four toner cartridges 34. Each of the out-of-toner sensors 35 includes a light-emitting unit 35*a* for emitting light SL and a light-receiving unit 35*b* for receiving the light SL emitted from the light-emitting unit 35*a*. The light-emitting unit 35*a* and the light-receiving unit 35*b* are disposed on the main casing 2. As will be described later, light-transmitting apertures 50A are formed in a unit-accommodating section 50 of the process unit 25. Four sets of the light-emitting units 35*a* and light-receiving units 35*b* are disposed with one member of each unit opposing the other so that light SL emitted from the light-emitting unit 35*a* passes through the light-transmitting apertures 50A in the unit-accommodating section 50 and the detection windows 37 of the toner cartridge 34. Since toner periodically lifted upward by the agitating operation of the agitator 42 periodically blocks the light SL of the out-of-toner sensor 35 from passing through the detection window 37, turning the out-of-toner sensor 35 OFF, it is possible to detect the amount of toner remaining in the toner-accommodating chamber 38 based on the length of time that the light is blocked (the sensor is OFF) or transmitted (the sensor is ON).

As shown in FIG. 1, the fixing unit 43 is disposed on the rear side of the conveying belt 18 within the main casing 2, and includes a heat roller 44, which is a driving roller, and a pressing roller 45, which is a driven roller. Although not shown in the drawings, the heat roller 44 includes a heat source, such as a halogen lamp. The pressing roller 45 is disposed in pressed contact with the heat roller 44. In the fixing unit 43, toner images of four colors are thermally fixed onto the paper 4 as the paper 4 is conveyed between the heat roller 44 and the pressing roller 45.

The paper-conveying path 6 has a paper-detecting mechanism 28 (FIG. 4) for detecting the presence of the paper 4. The paper-detecting mechanism 28 includes a post-registration sensor 28A and a discharge sensor 28B. The post-registration sensor 28A and the discharge sensor 28B are mechanical sensors that detect the paper 4 with pivotable detection members that are directly contacted by the paper 4. The sensors 28A and 28B turn ON when contacted by the leading edge of the paper 4 and turn OFF after the trailing edge of the paper 4 has passed. Therefore, the sensors 28A and 28B remain ON while pressed by the paper 4.

The post-registration sensor 28A is disposed on the paper-conveying path 6 downstream of the registration rollers 13 in the paper-conveying direction. The post-registration sensor 28A is normally used for setting a timing for starting image formation, but is also used for detecting paper jams, as will be described later.

The discharge sensor 28B is disposed downstream of the fixing unit 43 in the paper-conveying direction and is used for detecting paper jams, as will be described later.

Next, the electrical structure of the laser printer 1 will be described with reference to the block diagram in FIG. 4.

Figure 4:
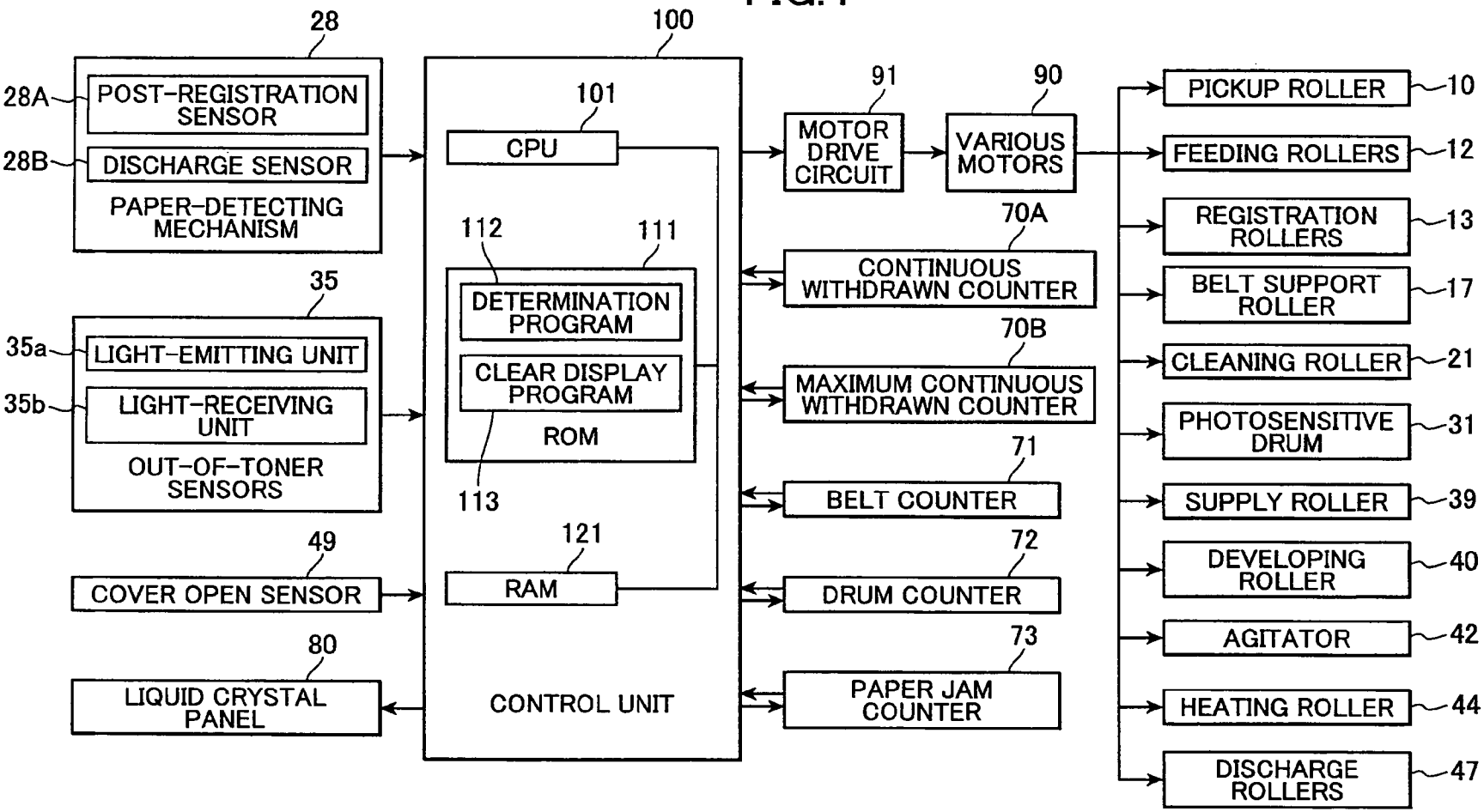
FIG. 4 is a block diagram showing the electrical structure of the laser printer.

As shown in FIG. 4, the laser printer 1 has a sensor system including the paper-detecting mechanism 28, the out-of-toner sensors 35, and the cover open sensor 49 described above; a continuous withdrawn counter 70A for measuring the amount of time that the process unit 25 is pulled out from the main casing 2 at least a prescribed distance; a maximum continuous withdrawn counter 70B for measuring the maximum time length during which the process unit 25 has been pulled out from the main casing 2 at least a prescribed distance within a period that the front cover 3 is opened and closed; a belt counter 71 for counting each revolution of the conveying belt 18; a drum counter 72 for counting each rotation of the photosensitive drum 31; a paper jam counter 73 for measuring the length of time of a conveying operation to determine when a paper jam has occurred; a liquid crystal panel 80 for displaying various messages and the like for the user; various motors 90 for generating rotational drive forces to drive rotary bodies (rollers and the like) in the laser printer 1 to rotate; a motor drive circuit 91 for driving the various motors 90; and a control unit 100 including a CPU 101, a ROM 111, and a RAM 121.

The CPU 101 can determine when the conveying belt 18 has made one revolution based on sensors (not shown) that detect marks and the like (not shown) on the conveying belt 18. The CPU 101 increments the belt counter 71 for each revolution of the conveying belt 18. The CPU 101 can also determine when the photosensitive drum 31 has completed one rotation based on a sensor (not shown) for detecting marks or the like (not shown) on the photosensitive drum 31. The CPU 101 increments the drum counter 72 for each rotation of the photosensitive drum 31. The CPU 101 can also determine the distance that the process unit 25 is pulled outward based on detection results of the out-of-toner sensors 35.

The various motors 90 generate drive forces for rotating the pickup roller 10, the sheet supply rollers 12, the registration rollers 13, the belt support roller 17, the cleaning roller 21, the photosensitive drums 31, the supply rollers 39, the developing rollers 40, the agitators 42, the heating roller 44, discharge rollers 47, and the like. Hence, these rollers and the like are driven to rotate by driving the various motors 90.

The ROM 111 stores various programs executed by the CPU 101, including a determination program 112 and a clear display program 113. The determination program 112 functions to perform various determinations based on detection results from the sensor system, including the paper-detecting mechanism 28, the out-of-toner sensors 35, and the cover open sensor 49, and the time measured by the maximum continuous withdrawn counter 70B. The clear display program 113 functions to clear an out-of-toner display or a paper jam display on the liquid crystal panel 80.

An operation of the laser printer 1 having the above configuration for forming images on the paper 4 will be described with reference to FIG. 1.

A top-most sheet of paper 4 on the pressing plate 9 is urged toward the pickup roller 10. Rotation of the pickup roller 10 brings the paper 4 to a position between the pickup roller 10 and the separating pad 11, and a single sheet of paper 4 is separated from the stack at one time. The sheet of paper 4 supplied by the pickup roller 10 and the separating pad 11 is conveyed to the registration rollers 13 by the sheet supply rollers 12. The registration rollers 13 perform a registration operation on the paper 4 and then convey the paper 4 at a proper timing onto the conveying belt 18 of the belt unit 15, The conveying belt 18 coveys the paper 4 to transfer positions between the photosensitive drums 31 and the transfer rollers 19.

Meanwhile, toner discharged from the toner accommodating chamber 38 is supplied to the developing roller 40 by the rotation of the supply roller 39 and positively tribocharged between the supply roller 39 and the developing roller 40. In association with the rotation of the developing roller 40, the toner on the developing roller 40 passes between the thickness regulating blade 41 and the developing roller 40, where the toner is even further tribocharged, while being regulated to a toner layer of a predetermined thin thickness on the developing roller 40.

As the photosensitive drum 31 rotates, first the charger 32 applies a uniform charge of positive polarity across the surface of the photosensitive drum 31. Subsequently, the surface of the photosensitive drum 31 is exposed by the high-scanning of the laser light L emitted from the scanner unit 27. As a result, electrostatic latent images corresponding to images to be formed on the paper 4 are formed on the surface of the photosensitive drum 31.

When the positively charged toner carried on the surface of the developing roller 40 are brought into opposition to and in contact with the photosensitive drum 31 as the developing roller 40 rotates, the toner is selectively supplied to the electrostatic latent images on the photosensitive drum 31. As a result, the electrostatic latent images on the photosensitive drum 31 are transformed into visible toner images. In this way, a reverse development is performed.

The toner images borne on the surfaces of the photosensitive drums 31 are sequentially transferred onto the paper 4 by a negative transfer bias applied to the transfer rollers 19, as the paper 4 on the conveying belt 18 passes through the transfer positions between the photosensitive drums 31 and the transfer rollers 19. The paper 4 with the toner images is conveyed to the fixing unit 43.

After the images are fixed onto the paper 4 in the fixing unit 43, the paper 4 is conveyed by a conveying roller 46 disposed diagonally above and rearward of the fixing unit 43 to the discharge rollers 47 disposed in the upper section of the main casing 2. Then, the discharge rollers 47 discharge the paper 4 onto the discharge tray 5.

The support structure of the process unit 25 will be described next with reference to FIGS. 1 and 3.

Figure 3:
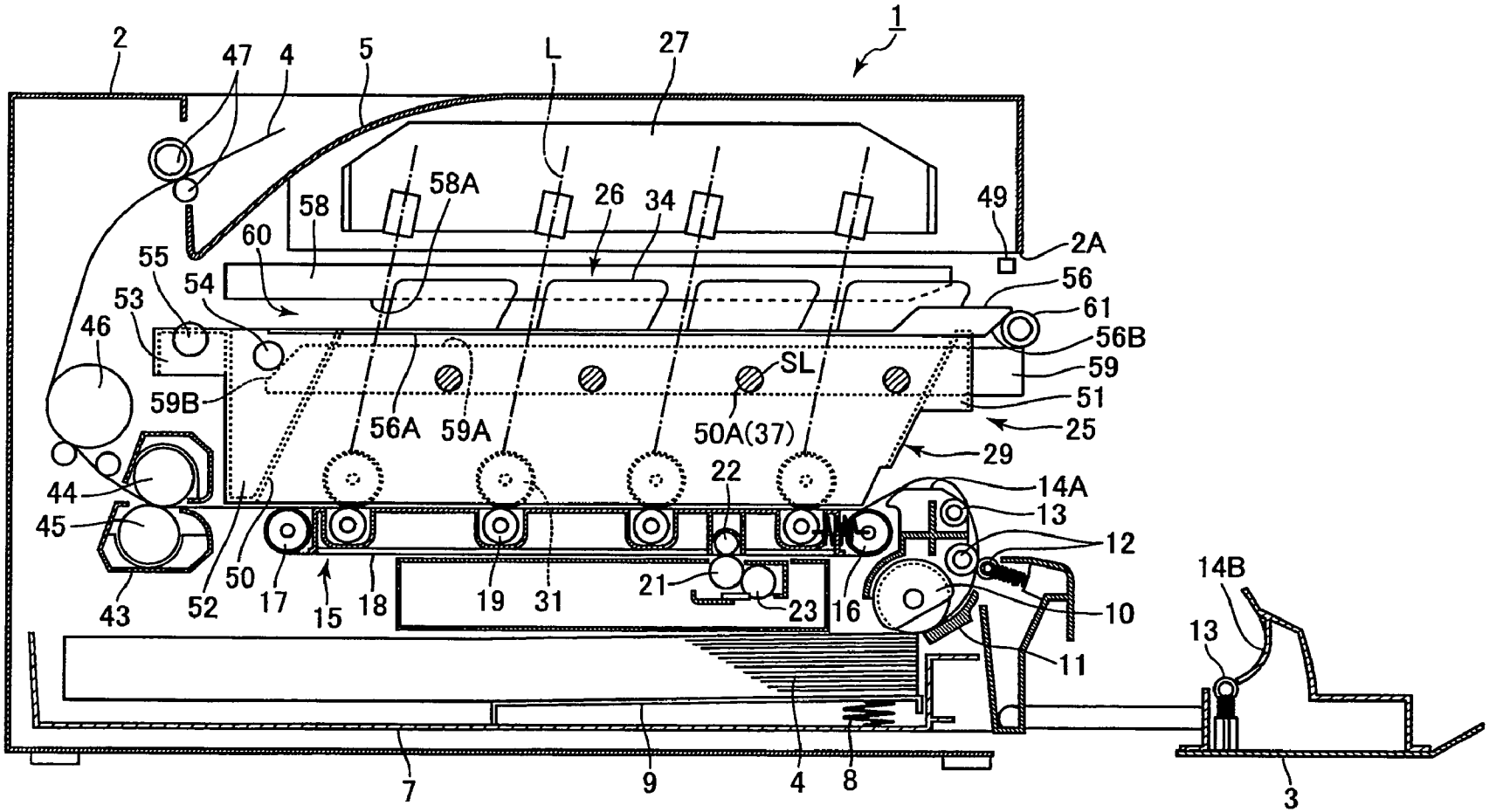
FIG. 3 is a side cross-sectional view of the laser printer when a front cover is open.

As shown in FIGS. 1 and 3, the frame 29 of the process unit 25 includes the unit-accommodating section 50 mentioned above for accommodating the four image-forming units 26 juxtaposed in the front-to-rear direction. A grip part 51 is formed on the upper front side of the unit-accommodating section 50. The rear end of the unit-accommodating section 50 projects gradually farther rearward toward the bottom thereof. An expanded section 52 having the same height and width dimensions as the unit-accommodating section 50 is formed on the rear side of the unit-accommodating section 50 to project rearward. The front portion of the expanded section 52 is disposed on the rear of the unit-accommodating section 50 so as to vertically overlap the projecting portion of the unit-accommodating section 50. The rear edge of the expanded section 52 forms a vertical surface (orthogonal to the direction in which the process unit 25 is pulled). A protruding part 53 spanning the entire width of the expanded section 52 is formed on the upper rear surface of the expanded section 52 and projects rearward. The fixing unit 43 is disposed rearward of the unit-accommodating section 50 (rearward of the expanded section 52) and vertically below (a direction orthogonal to the pulling direction) the protruding part 53.

A first support part 54 configured of a rotary member is mounted in the upper left and right side surfaces of the expanded section 52 A second support part 55 configured of a rotary member is mounted in the left and right side surfaces of the protruding part 53. As shown in FIG. 3, plate-shaped support receiving walls 56 are formed on the top end of both left and right side surfaces of the frame 29 extending forward from the position of the first support part 54 in the front-to-rear direction (pulling direction) and expanding outward horizontally. Each support receiving wall 56 includes a horizontal surface 56A extending in the front-to-rear direction, and a guide surface 56B continuing from the front end of the horizontal surface 56A and sloping upward toward the front.

Figure 5:
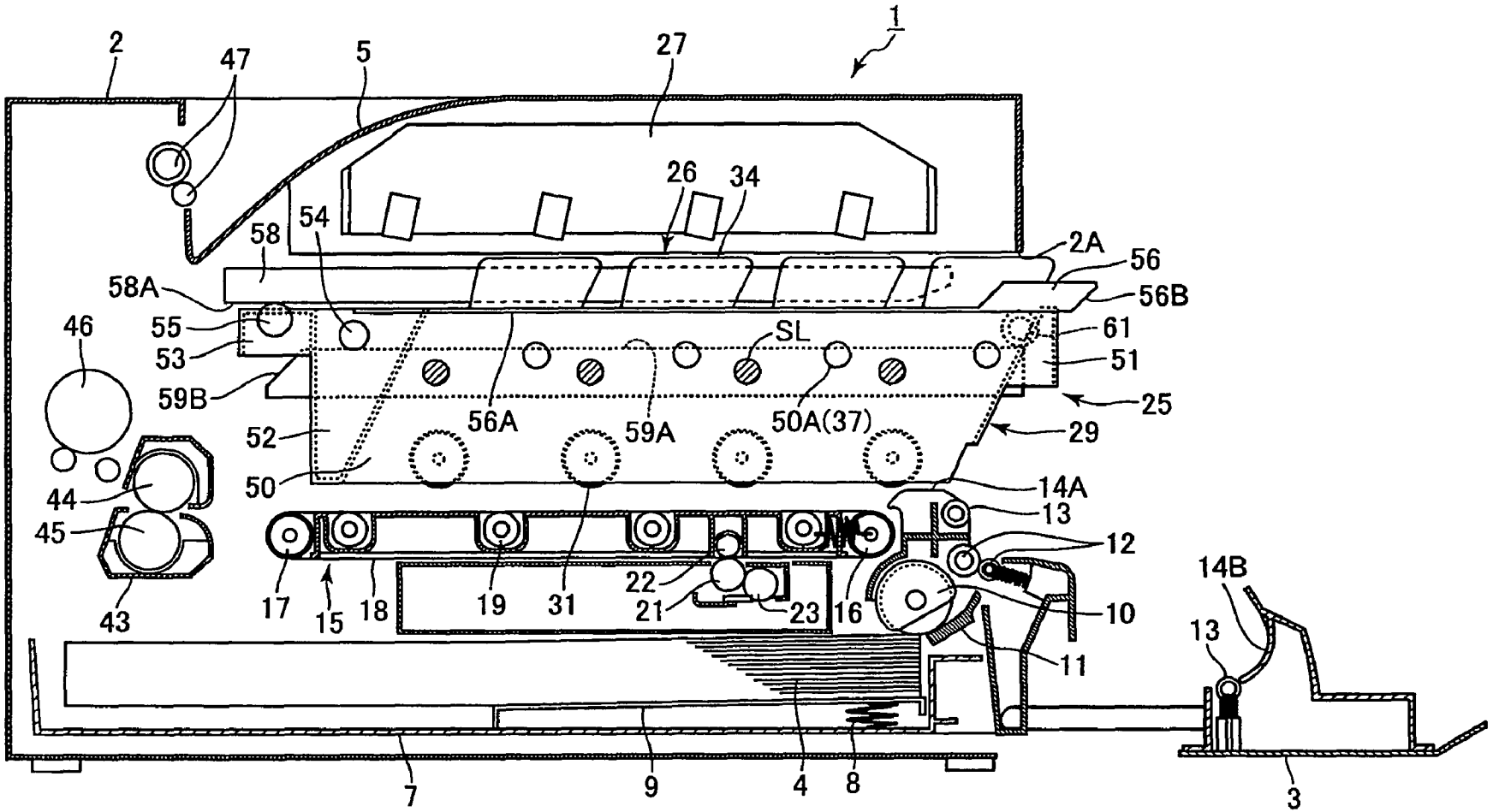
FIG. 5 is a side cross-sectional view of the laser printer when a process unit is partially withdrawn.

As shown in FIG. 5, the four light-transmitting apertures 50A are formed in each side surface of the unit-accommodating section 50 at positions corresponding to the detection windows 37 in the toner cartridges 34 to allow the passage of light produced by the out-of-toner sensors 35 The light-transmitting apertures 50A are positioned along a straight line connecting all four toner cartridges 34.

As shown in FIG. 3, a pair of upper and lower guiding walls 58 and 59 are disposed inside the main casing 2 on both the left and right sides of the process unit 25, The guiding walls 58 and 59 extend in the front-to-rear direction and have substantially the same length as the process unit 25. Each of the upper guiding walls 58 includes a downward-facing guide surface 58A, and each of the lower guiding walls 59 includes an upward-facing guide surface 59A. The guide surfaces 58A and 59A are arranged parallel to each other and oppose each other over a prescribed gap. This gap formed between the guide surfaces 58A and 59A is a groove 60. As will be described later, the groove 60 receives the insertion of the pair of support parts 54 and 55 of the process unit 25, and the guiding walls 58 and 59 support the process unit 25 with the first support part 54 in contact with the guide surfaces 59A and the second support part 55 in contact with the guide surfaces 58A. Each of the lower guiding walls 59 also has a guide surface 59B formed on the rear edge of the lower guiding wall 59. The guide surface 59B slopes upward toward the front to meet the rear end of the guide surface 59A.

The support receiving walls 56 of the process unit 25 are disposed in the groove 60 so as not to contact the guide surfaces 58A and 59A. A support part 61 is also provided on the front edge of the guide surfaces 59A (the front end of the groove 60). The support part 61 is configured of a rotary body maintained in a rotatable state and may be configured of a rotational shaft covered with an elastic member, such as a rubber material. The support part 61 supports the process unit 25 with the support receiving walls 56 resting on the top surface of the support part 61.

Next, operations for removing and mounting the process unit 25 from and into the main casing 2 will be described.

As shown in FIGS. 1 and 3, when the process unit 25 is mounted at the proper mounting position in the main casing 2, the guide surfaces 56B of the support receiving walls 56 rest on the top surface of the support part 61, and the first support part 54 rests on the guide surfaces 59B of the lower guiding walls 59. Hence, the support part 61 and the lower guiding walls 59 support the process unit 25 in a horizontal orientation. At this time, the photosensitive drums 31 contact the top surface of the conveying belt 18.

To pull the process unit 25 out of the main casing 2, the front cover 3 is first opened, as shown in FIG. 3, and the process unit 25 is pulled forward. At this time, the front ends of the support receiving walls 56 and the first support part 54 are guided upward almost simultaneously along the guide surfaces 56B and the guide surfaces 59B as the process unit 25 is pulled, so that the process unit 25 moves upward at a slant. Since this upward movement separates the photosensitive drums 31 from the conveying belt 18, the process unit 25 can be pulled smoothly outward without the photosensitive drums 31 sliding over the conveying belt 18.

With this upward movement, as shown in FIG. 5, the horizontal surfaces 56A of the support receiving walls 56 ride up onto the support part 61, and the first support part 54 rides up onto the guide surfaces 59A of the lower guiding walls 59, so that the second support part 55 contacts the guide surfaces 58A of the upper guiding walls 58. In this state, the lower end of the process unit 25 (lower edges of the photosensitive drums 31) is maintained in a higher position than the guide member 14A disposed near the lower edge of the opening 2A. In addition, the light-transmitting apertures 50A formed in both side surfaces of the unit-accommodating section 50 are maintained at a higher position than light beams SL produced in the out-of-toner sensors 35. Accordingly, when the process unit 25 is in the position shown in FIG. 5, the light beams SL generated by the out-of-toner sensors 35 are blocked by the side surface of the unit-accommodating section 50.

Figure 6:
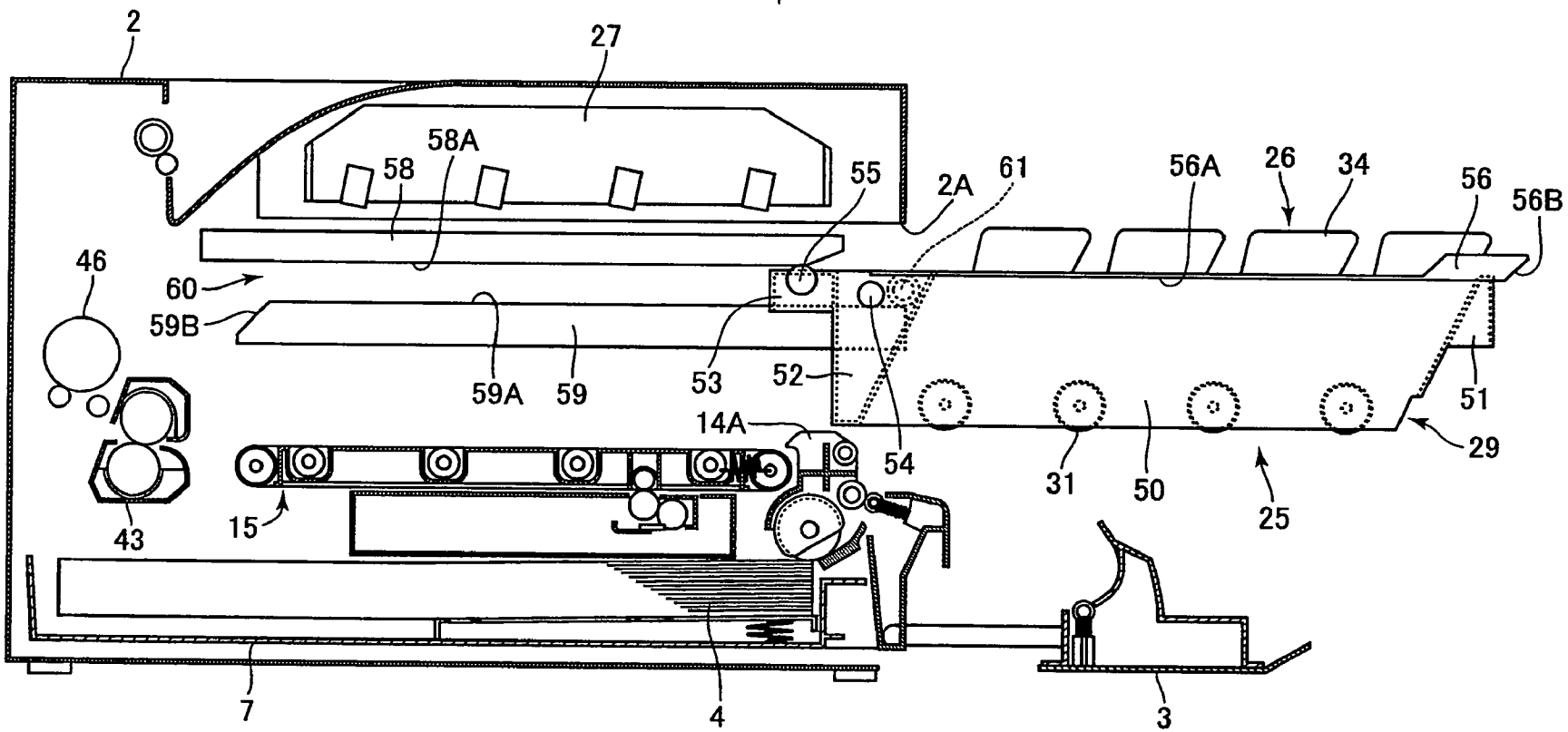
FIG. 6 is a side cross-sectional view of the laser printer when the process unit is completely withdrawn.

When the process unit 25 is pulled farther forward, vertical tilting of the process unit 25 is restricted through contact between the support parts 54, 55 and the guiding walls 58, 59, allowing the process unit 25 to be guided forward in a horizontal orientation. When the process unit 25 is pulled to a position in which nearly the entire unit-accommodating section 50 is exposed outside of the opening 2A, as shown in FIG. 6, the first support part 54 contacts and engages with the support part 61, restricting the process unit 25 from being pulled farther. The toner cartridges 34 and the photosensitive drums 31 can be replaced while the process unit 25 is in this position.

Figure 7:
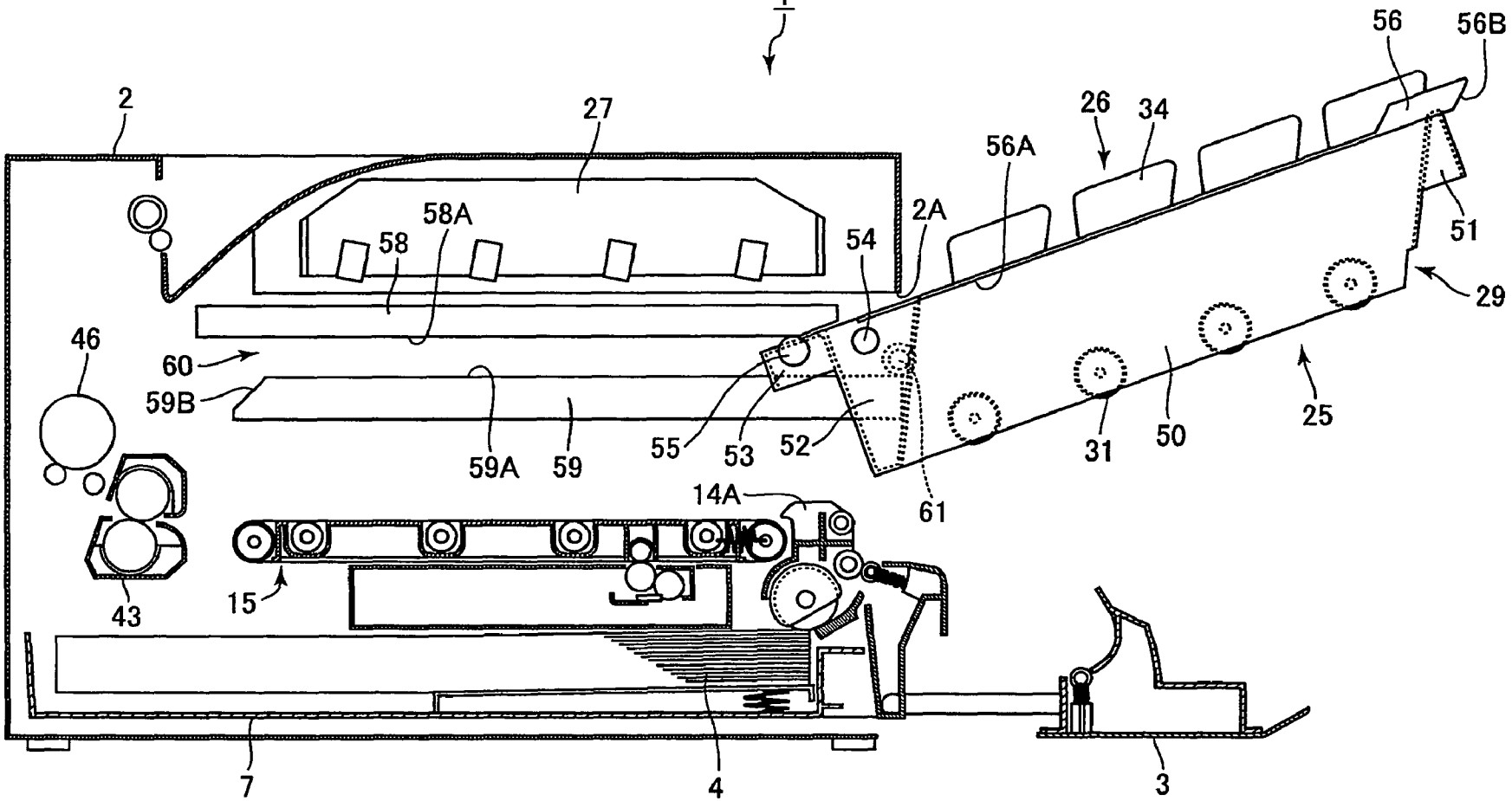
FIG. 7 is a side cross-sectional view of the laser printer when the process unit is being detached from a main casing of the laser printer.
Figure 8A:
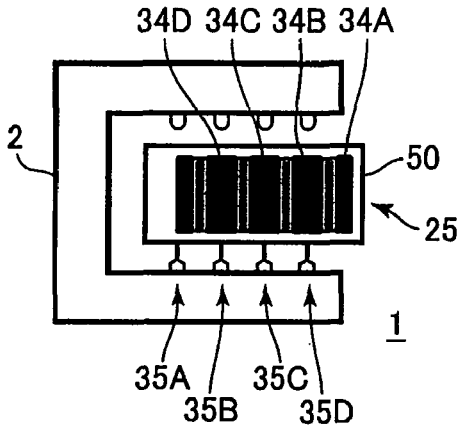
FIG. 8(*a*) is a horizontal cross-sectional view conceptually showing the laser printer in the state shown in FIG. 5.
Figure 8D:
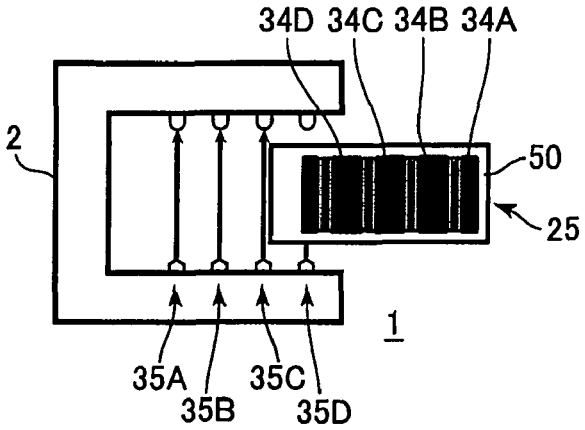
Figure 8B:
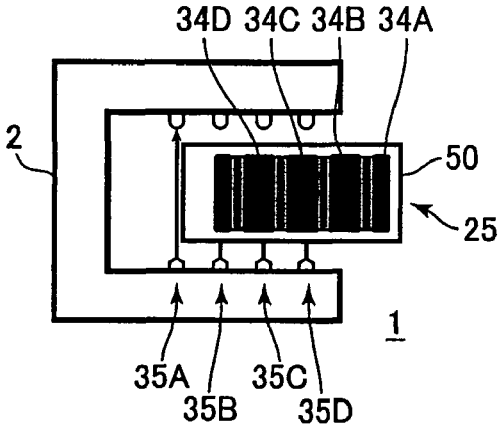
Figure 8E:
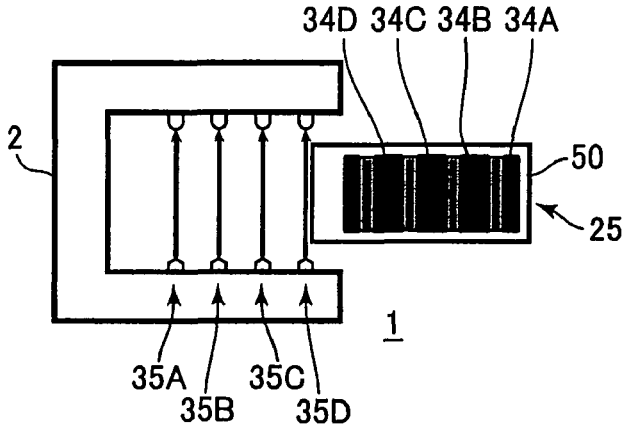
Figure 8C:
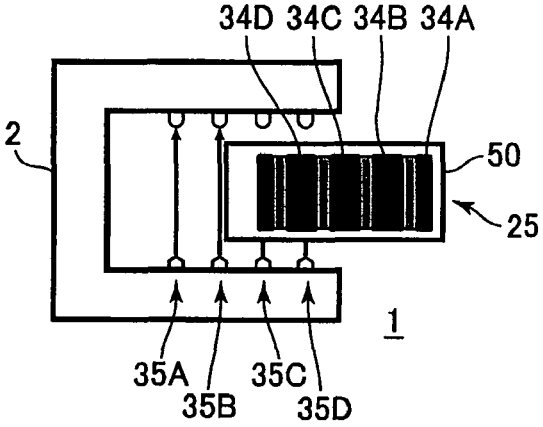
Figure 9A:
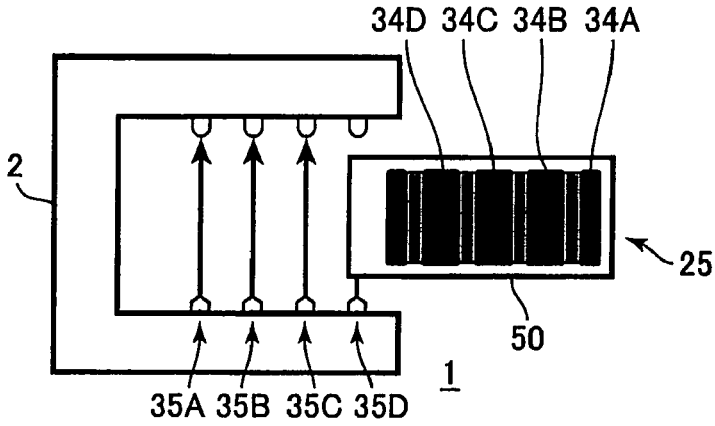
FIG. 9(*a*) is a horizontal cross-sectional view conceptually showing the laser printer as the process unit is inserted into the main casing deeper than a first out-of-toner sensor.
Figure 9B:
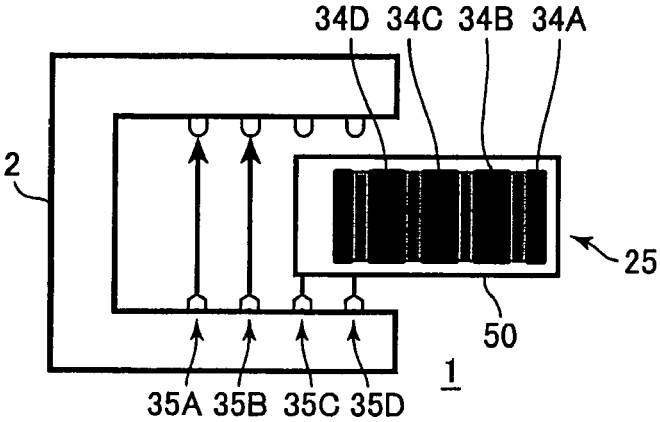
Figure 9C:
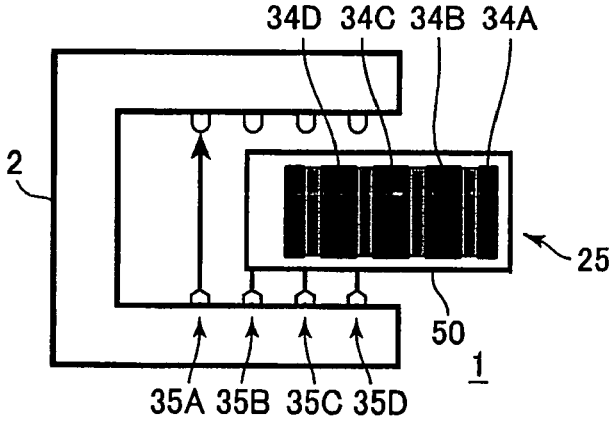
Figure 9D:
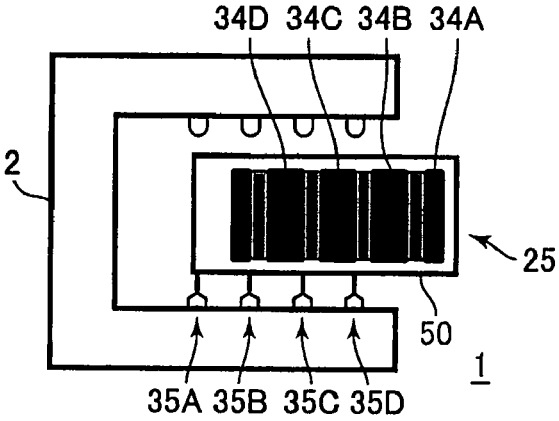

In order to remove the process unit 25 from the main casing 2, the user grips the grip part 51 and lifts the front end of the process unit 25 upward so that the process unit 25 slopes downward toward the rear end, as shown in FIG. 7. At this time, the second support part 55 lowers into contact with the guide surface 59A, while the first support part 54 rises up from the guide surface 59A and disengages from the support part 61. The first support part 54 and the support part 61 can easily disengage at this time since both members are capable of rotating. The user then separates the process unit 25 from the main casing 2 by pulling the process unit 25 diagonally upward and forward while the process unit 25 is in this sloped state. Removing the process unit 25 from the main casing 2 exposes the opening 2A, enabling the user to access the conveying belt 18 and the paper-conveying path 6. This facilitates such maintenance operations as replacing the conveying belt 18 and removing paper that has become jammed in the paper-conveying path 6, as well as facilitating replacement of the image-forming units 26.

When remounting the process unit 25 in the main casing 2, the procedure is performed in reverse. That is, with the process unit 25 in a diagonal orientation sloping downward to the rear, the support parts 54 and 55 are inserted into the groove 60, after which the process unit 25 is pushed into the main casing 2 in a horizontal state. When the first support part 54 arrives at the guide surfaces 59B of the lower guiding walls 59 and the guide surfaces 56B of the support receiving walls 56 arrive at the support part 61, the process unit 25 moves diagonally downward into the proper mounted position while maintained in a substantially horizontal state. At this time, the photosensitive drums 31 contact the top surface of the conveying belt 18.

Next, detection changes in the out-of-toner sensors 35 occurring when the process unit 25 is pulled outward will be described. In FIGS. 8(*a*) to 9(*d*), the four toner cartridges 34 are differentiated by using the reference numeral 34A for the toner cartridge positioned nearest the front of the laser printer 1, 34B for the toner cartridge positioned second nearest, 34C for the toner cartridge positioned third nearest, and 34D for the toner cartridge positioned fourth nearest (deepest) (hereinafter referred to as "first toner cartridge 34A," "second toner cartridge 34B," "third toner cartridge 34C," and "fourth toner cartridge 34D," respectively). Similarly, the four out-of-toner sensors 35 are differentiated by using the reference numeral 35A for the out-of-toner sensor positioned fourth nearest the front of the laser printer 1 (deepest), 35B for the out-of-toner sensor positioned third nearest, 35C for the out-of-toner sensor positioned second nearest, and 35D for the out-of-toner sensor positioned nearest the front of the laser printer 1 (hereinafter referred to as "fourth out-of-toner sensor 34A," "third out-of-toner sensor 34B," "second out-of-toner sensor 34C," "first out-of-toner sensor 34D," respectively).

First, changes in detection results from the out-of-toner sensors 35A-35D when the process unit 25 is pulled from the main casing 2 to its maximum range and subsequently reinserted into the main casing 2 will be described. For the sake of description, it will be assumed that the process unit 25 is removed and inserted at a constant speed.

Figure 10:
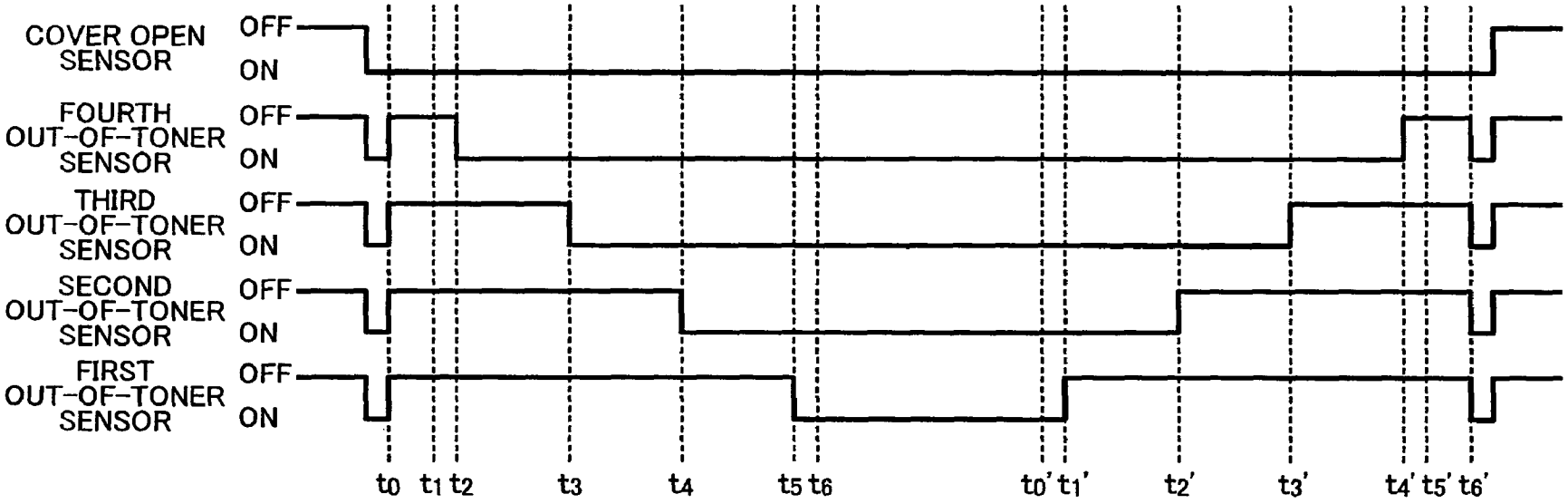
FIG. 10 is a timing chart showing the ON/OFF state of the out-of-toner sensors when the process unit is withdrawn from the main casing to the end of its maximum range and is subsequently reinserted into the main casing.

As shown in FIG. 10, the four out-of-toner sensors 35A to 35D turn ON at the same time the cover open sensor 49 turns ON, that is, when the front cover 3 is opened. If the user begins to pull the process unit 25 at a time $t_0$, all four out-of-toner sensors 35A to 35D turn OFF because the lights generated therein are blocked by the side surface of the unit-accommodating section 50. After the process unit 25 has been pulled for a time $t_1$, the lower edge of the process unit 25 is maintained higher than the guide member 14A as shown in FIG. 5. Accordingly, the lights generated in the out-of-toner sensors 35A to 35D are still blocked by the side surface of the unit-accommodating section 50, and the out-of-toner sensors 35A to 35D remain OFF (see FIG. 8(*a*)). When a time $t_2$ has elapsed, the rear surface of the unit-accommodating section 50 moves forward of the fourth out-of-toner sensor 35A as shown in FIG. 8(*b*), and hence, only the fourth out-of-toner sensor 35A turns ON. After a time $t_3$ has elapsed, the rear surface of the unit-accommodating section 50 moves forward of the third out-of-toner sensor 35B as shown in FIG. 8(*c*), enabling the third out-of-toner sensor 35B to turn ON together with the fourth out-of-toner sensor 35A. After a time $t_4$ has elapsed, the rear surface of the unit-accommodating section 50 moves forward of the second out-of-toner sensor 35C as shown in FIG. 8(*d*), enabling the second out-of-toner sensor 35C to turn ON together with the fourth and third out-of-toner sensors 35A, 35B After a time $t_5$ has elapsed, the rear surface of the unit-accommodating section 50 moves forward of the first out-of-toner sensor 35D as shown in FIG. 8(*e*), enabling the first out-of-toner sensor 35D to turn ON together with the fourth, third, and second out-of-toner sensors 35A, 35B, 35C. After a time $t_6$ has elapsed, the process unit 25 has been withdrawn to the end of its maximum range as shown in FIG. 6, and a process. to insert the process unit 25 begins from a time $t_0'$.

After a time $t_1'$ has elapsed since the beginning of insertion, the rear surface of the unit-accommodating section 50 has advanced deeper than the first out-of-toner sensor 35D as shown in FIG. 9(*a*), thereby turning OFF only the first out-of-toner sensor 35D. After a time $t_2'$ has elapsed since the beginning of insertion, the rear surface of the unit-accommodating section 50 has advanced deeper than the second out-of-toner sensor 35C as shown in FIG. 9(*b*), thereby turning OFF the second out-of-toner sensor 35C together with the first out-of-toner sensor 35D. After a time $t_3'$ has elapsed since the beginning of insertion, the rear surface of the unit-accommodating section 50 has advanced deeper than the third out-of-toner sensor 35B as shown in FIG. 9(*c*), thereby turning OFF the third out-of-toner sensor 35B together with the first and second out-of-toner sensors 35D, 35C. After a time $t_4'$ has elapsed since the beginning of insertion, the rear surface of the unit-accommodating section 50 has advanced deeper than the fourth out-of-toner sensor 35A as shown in FIG. 9(*d*), thereby turning OFF the fourth out-of-toner sensor 35A together with the first to third out-of-toner sensors 35D, 35C, 35B. After a time $t_5'$ has elapsed, the lower edge of the process unit 25 is still maintained higher than the guide member 14A as shown in FIG. 5. Accordingly, the lights generated in the out-of-toner sensors 35A to 35D are still blocked by the side surface of the unit-accommodating section 50, and the out-of-toner sensors 35A to 35D remain OFF (see FIG. 8(*a*)). After a time $t_6'$ has elapsed, the process unit 25 has been completely inserted into the main casing 2 as shown in FIG. 3. At this time, the lights generated in all four out-of-toner sensors 35A to 35D pass through the light-transmitting apertures 50A of the unit-accommodating section 50 as shown in FIG. 2, and hence, all out-of-toner sensors 35A to 35D are ON. All four out-of-toner sensors 35 turn OFF at the same time the cover open sensor 49 turns OFF.

Next, description will be provided for changes in detection results from the four out-of-toner sensors 35A to 35D when the process unit 25 is only pulled from the main casing 2 to a position in which the two nearest toner cartridges 34A and 34B can be removed, and is subsequently reinserted into the main casing 2. Note that the changes in detection results of the out-of-toner sensors 35A to 35D follow the same principles when the process unit 25 is pulled out to a position for removing only the first toner cartridge 34A or for removing the first to third toner cartridges 34A to 34C, and is subsequently reinserted into the main casing 2. Accordingly, a description of these operations has been omitted. For the sake of description, it will be assumed that the process unit 25 is removed and inserted at a constant speed.

Figure 11:
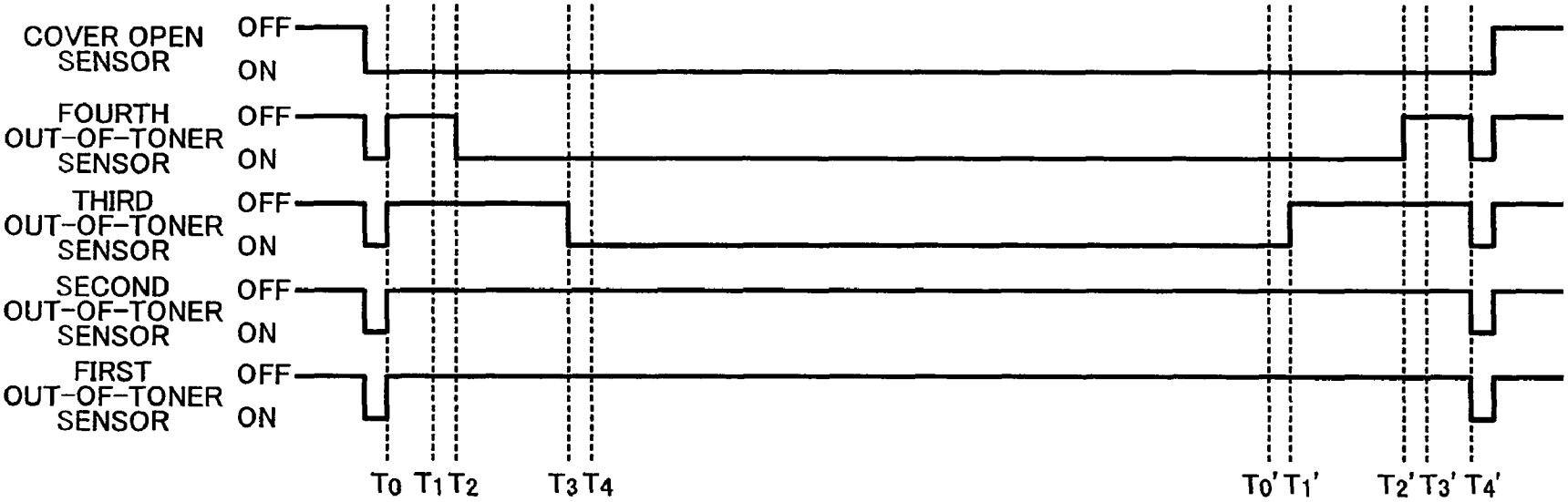
FIG. 11 is a timing chart showing the ON/OFF state of the out-of-toner sensors when the process unit is withdrawn from the main casing to a position at which the first and second toner cartridges can be removed and is subsequently reinserted into the main casing.

As shown in FIG. 11, the four out-of-toner sensors 35A to 35D turn ON at the same time the cover open sensor 49 turns ON. If the user begins to pull the process unit 25 at a time $T_0$, all four out-of-toner sensors 35A to 35D turn OFF when the lights generated therein are blocked by the side surface of the unit-accommodating section 50. After the process unit 25 has been pulled for a time $T_1$, the lower edge of the process unit 25 is maintained higher than the guide member 14A as shown in FIG. 5. Accordingly, the lights generated in the out-of-toner sensors 35A to 35D are still blocked by the side surface of the unit-accommodating section 50 as shown in FIG. 8(*a*), and the out-of-toner sensors 35A to 35D remain OFF. When a time $T_2$ has elapsed, the rear surface of the unit-accommodating section 50 moves forward of the fourth out-of-toner sensor 35A as shown in FIG. 8(*b*), and hence, only the fourth out-of-toner sensor 35A turns ON. After a time $T_3$ has elapsed, the rear surface of the unit-accommodating section 50 moves forward of the third out-of-toner sensor 35B as shown in FIG. 8(*c*), enabling the third out-of-toner sensor 35B to turn ON together with the fourth out-of-toner sensor 35A. After a time $T_4$ has elapsed, the process unit 25 is halted at a position in which the first and second toner cartridges 34A and 34B can be removed. Subsequently, the process unit 25 is reinserted beginning from a time $T_0'$. Accordingly, the first and second out-of-toner sensors 35D and 35C remain OFF during the entire operation for withdrawing the process unit 25.

After a time $T_1'$ has elapsed since the beginning of insertion, the. rear surface of the unit-accommodating section 50 has advanced deeper than the third out-of-toner sensor 35B as shown in FIG. 9(*c*), thereby turning OFF the third out-of-toner sensor 35B together with the first and second out-of-toner sensors 35D, 35C. After a time $T_2'$ has elapsed since the beginning of insertion, the rear surface of the unit-accommodating section 50 has advanced deeper than the fourth out-of-toner sensor 35A as shown in FIG. 9(*d*), thereby turning OFF the fourth out-of-toner sensor 35A together with the first to third out-of-toner sensors 35D, 35C, 35B. After a time $T_3'$ has elapsed, the lower edge of the process unit 25 is still maintained higher than the guide member 14A as shown in FIG. 5. Accordingly, the lights generated in the out-of-toner sensors 35A to 35D are still blocked by the side surface of the unit-accommodating section 50 as shown in FIG. 8(*a*), and the out-of-toner sensors 35A to 35D remain OFF. After a time $T_4'$ has elapsed, the process unit 25 has been completely inserted into the main casing 2 as shown in FIG. 3. At this time, the lights generated in all four out-of-toner sensors 35 pass through the light-transmitting apertures 50A of the unit-accommodating section 50 as shown in FIG. 2, and hence, all out-of-toner sensors 35A to 35D are turned ON. All four out-of-toner sensors 35 turn OFF at the same time the cover open sensor 49 turns OFF.

As described above, the CPU 101 can determine the distance that the process unit 25 has been pulled from the main casing 2 by monitoring changes in the ON/OFF state of the four out-of-toner sensors 35A to 35D.

Next, the process executed by the CPU 101 will be described.

The consumption states and drive states of various components in the laser printer 1 change as the laser printer 1 performs image-forming operations. The following is a description of various processes performed to display these consumption states and drive states on the liquid crystal panel 80 provided on the outside of the main casing 2.

First, a paper-jam clear display process for displaying a message prompting the user to clear a paper jam will be described with reference to FIG. 12.

Figure 12:
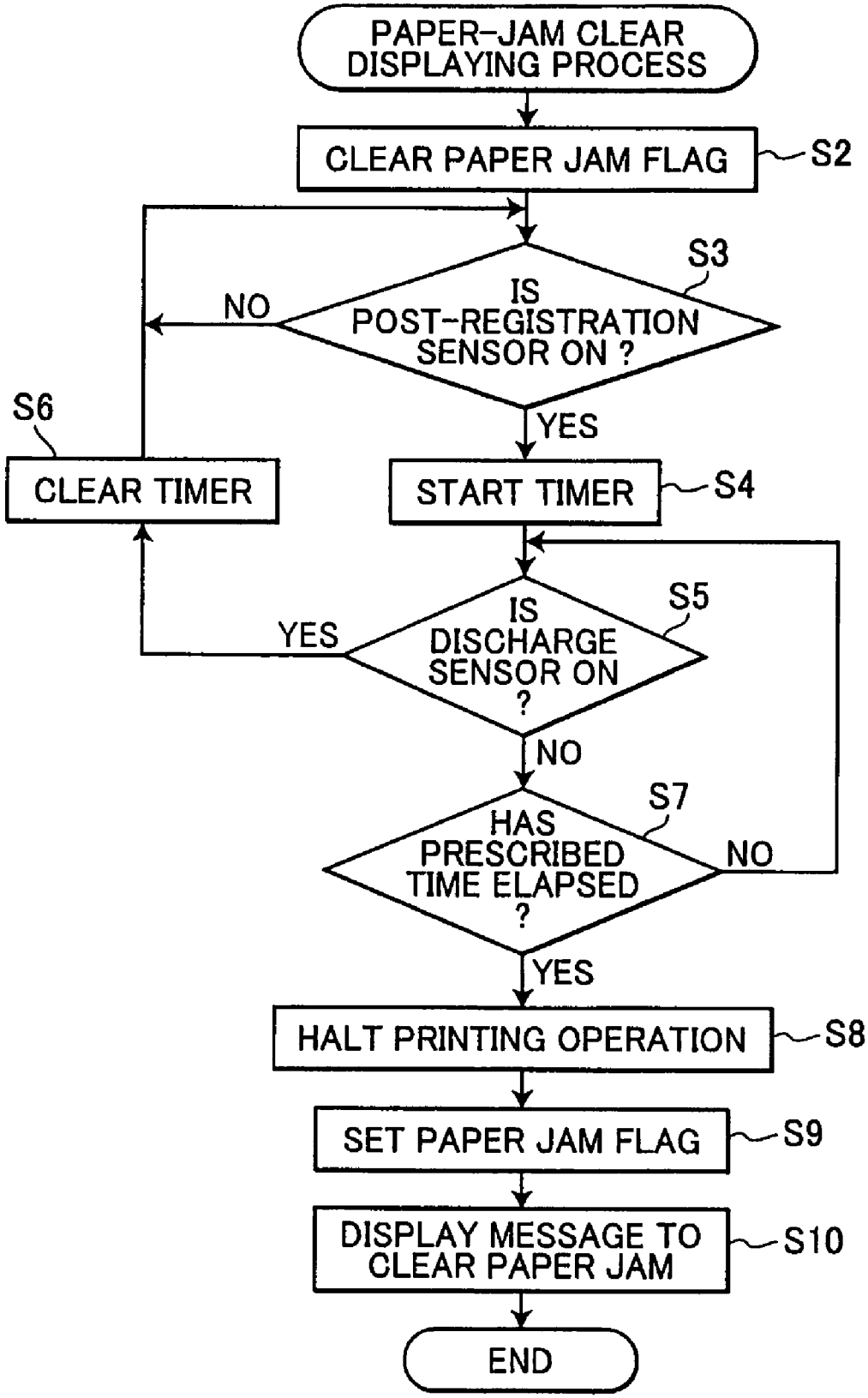
FIG. 12 is a flowchart representing a paper jam clear displaying process.

In the process shown in FIG. 12, the CPU 101 clears a paper jam flag in S2. In S3, the CPU 101 executes the determination program 112 to determine whether the post-registration sensor 28A has detected passage of the paper 4. The CPU 101 repeats the determination in S3 as long as the post-registration sensor 28A has not detected the paper 4 (S3: NO). However, when the post-registration sensor 28A has detected the paper 4 (S3: YES), then in S4, the CPU 101 starts the paper jam counter 73, and in S5, determines whether the discharge sensor 28B has detected the paper 4. If so (S5: YES), then the CPU 101 clears the value of the paper jam counter 73 in S6 and returns to S3. However, if the discharge sensor 28B has not detected passage of the paper 4 in S5 (S5: NO), then in S7, the CPU 101 determines whether the paper jam counter 73 has reached a prescribed time. If not (S7: NO), then assuming that the paper 4 is being conveyed along the section of the paper-conveying path 6 from the post-registration sensor 28A to the discharge sensor 28B, the CPU 101 returns to S5. However, if the value of the paper jam counter 73 has reached a prescribed time (S7: YES), then the CPU 101 determines that the paper 4 has become jammed along the section of the paper-conveying path 6 from the post-registration sensor 28A to the discharge sensor 28B. Accordingly, in SB, the CPU 101 stops the motor drive circuit 91 from driving the various motors 90, halting the image-forming operation of the laser printer 1. In S9, the CPU 101 sets the paper jam flag, and in S10, displays a message, such as "A paper jam has occurred. Please remove the paper" on the liquid crystal panel 80, prompting the user to clear the jammed paper. Subsequently, the process ends.

Next, a toner-cartridge replacement display process for displaying a message prompting the user to replace the toner cartridge 34 will be described with reference to FIG. 13. Since this process is identical for each of the toner cartridges 34, the process is described below for a single toner cartridge 34.

Figure 13:
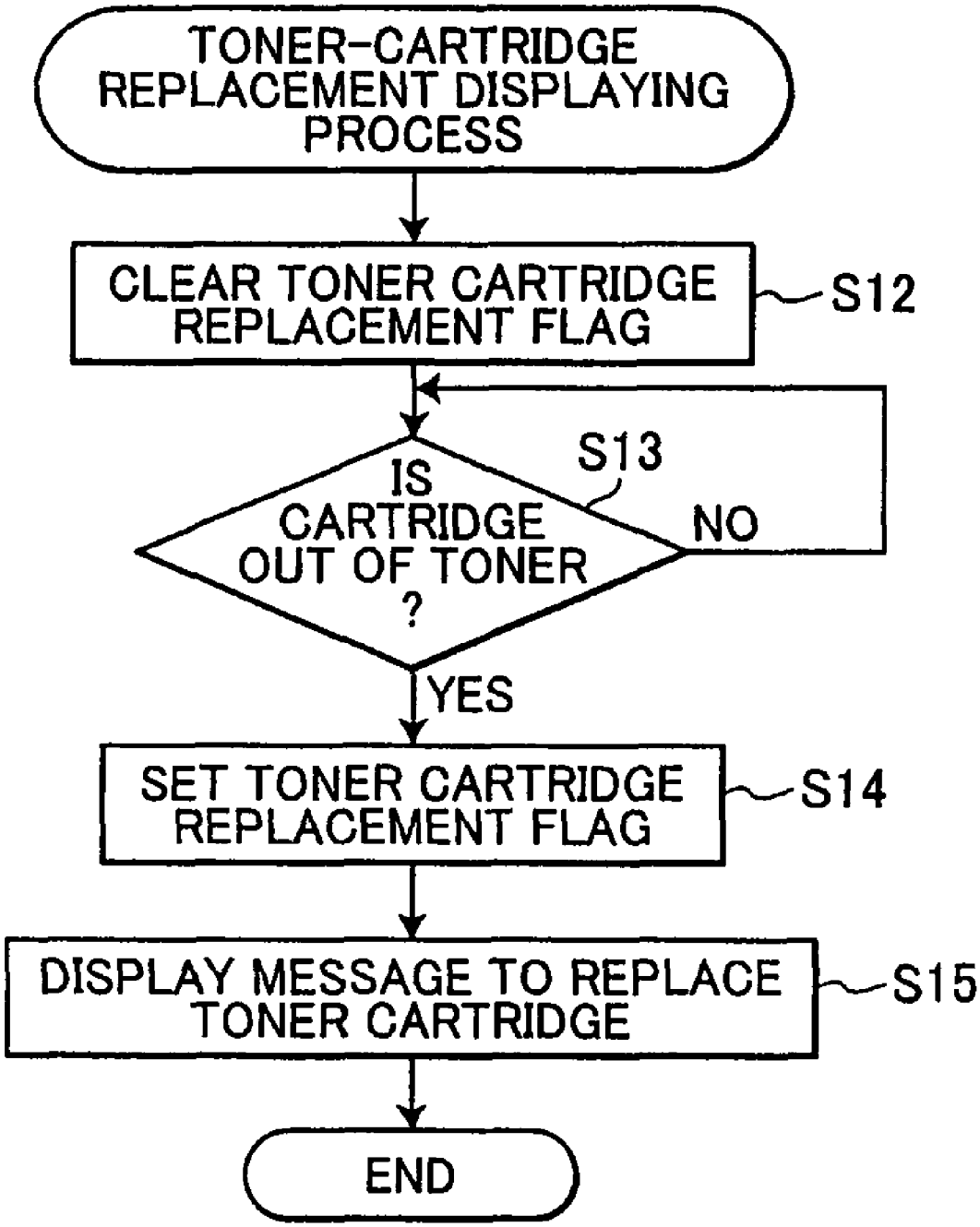
FIG. 13 is a flowchart representing a toner cartridge replacement displaying process.

In S12 of FIG. 13, the CPU 101 first clears a toner-cartridge replacement flag. In S13, the CPU 101 executes the determination program 112 for determining whether the amount of toner in the toner cartridge 34 detected by the out-of-toner sensor 35 is less than a prescribed amount (out-of-toner). The CPU 101 continually performs the determination in S13 as long as the out-of-toner sensor 35 has not detected that the toner cartridge 34 is out-of-toner (S13: NO) However, when it is determined that the toner cartridge 34 is out of toner (S13: YES), then in S14, the CPU 101 sets the toner-cartridge replacement flag. In S15, the 101 displays a message, such as "Please replace the black toner cartridge," on the liquid crystal panel 80, prompting the user to replace the appropriate toner cartridge 34, and the process ends.

Next, a photosensitive-drum replacement displaying process for prompting the user to replace the photosensitive drums 54 will be described with reference to FIG. 14.

Figure 14:
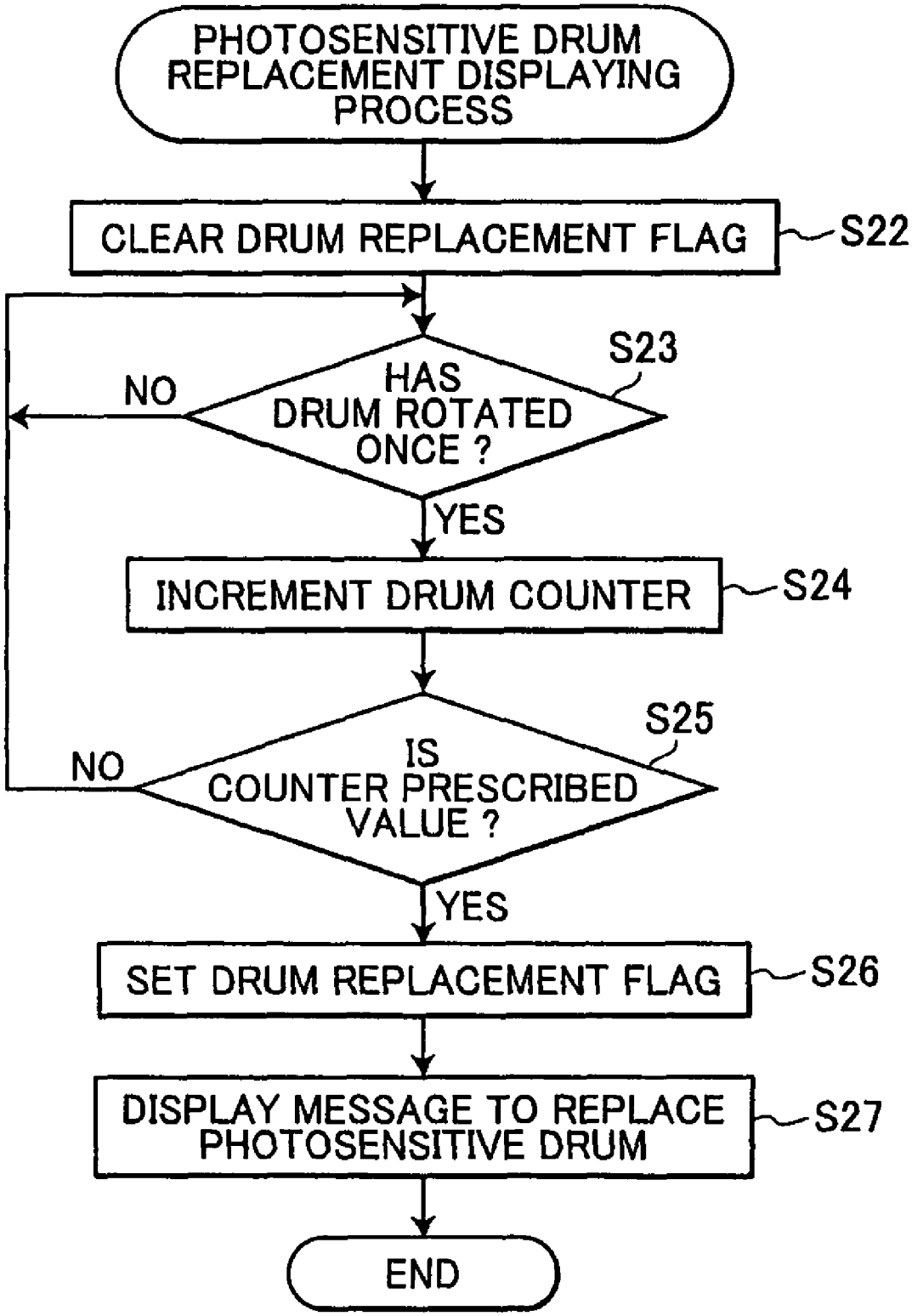
FIG. 14 is a flowchart representing a photosensitive-drum replacement displaying process.

As shown in FIG. 14, the CPU 101 first clears a drum replacement flag in S22. In S23, the CPU 101 executes the determination program 112 for determining whether a sensor (not shown) has detected one rotation of a particular one of the photosensitive drums 31. This determination is repeated until the photosensitive drum 31 has completed one rotation. When the CPU 101 determines that the photosensitive drum 31 has completed one rotation (S23: YES), in S24, the CPU 101 increments the count value in the drum counter 72 by 1 and in S25, determines whether this count value has reached a prescribed value. If not (S25: NO), the CPU 101 returns to S23. On the other hand, if so (S25: YES), the CPU 101 determines that the current photosensitive drums 31 have reached the end of their life, and in S26, sets the drum replacement flag. In S27, the CPU 101 displays a message, such as "Please replace the photosensitive drums," on the liquid crystal panel 80, prompting the user to replace the photosensitive drums 31 with new drums. Subsequently, the process ends.

Next, a conveying-belt replacement displaying process to display a message prompting the user to replace the conveying belt 18 will be described with reference to FIG. 15.

Figure 15:
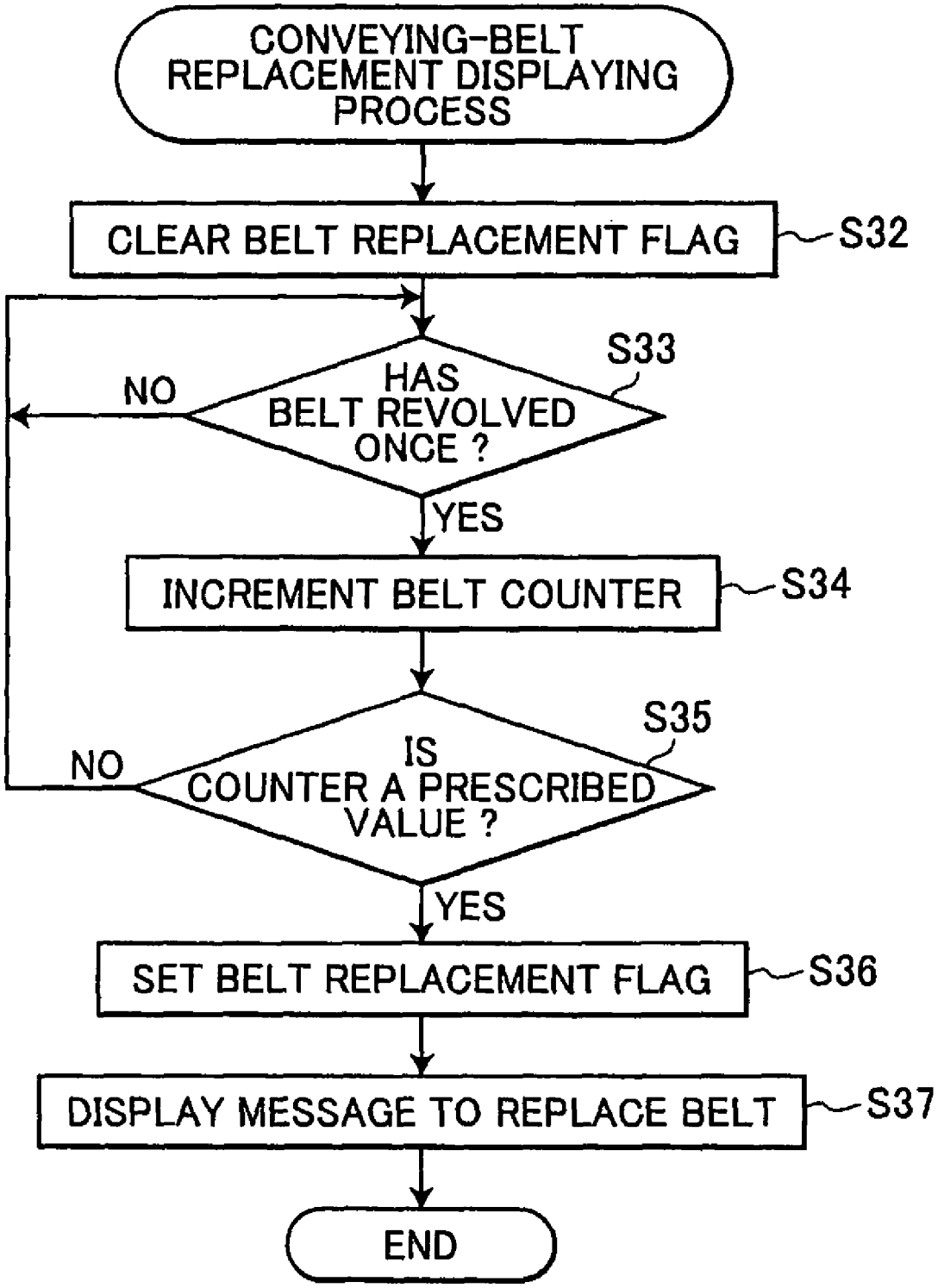
FIG. 15 is a flowchart representing a conveying-belt replacement displaying process.

As shown in FIG. 15, the CPU 101 first clears a belt replacement flag in S32. In S33, the CPU 101 executes the determination program 112 for determining whether a sensor (not shown) has detected one rotation of the conveying belt 18. This determination is repeated until the conveying belt 18 has completed one rotation. When the CPU 101 determines that the conveying belt 18 has completed one rotation (S33: YES), then in S34, the CPU 101 increments the count value in the belt counter 71 by 1, and in S35, determines whether this count value has reached a prescribed value. If not (S35: NO), then the CPU 101 returns to S33. On the other hand, if so (S35: YES), then the CPU 101 determines that the current conveying belt 18 has reached the end of its life, and in S36, sets the belt replacement flag. In S37, the CPU 101 displays a message, such as "Please replace the conveying belt," on the liquid crystal panel 80, prompting the user to replace the conveying belt 18 with a new belt. Subsequently, the process ends.

After viewing the content displayed on the liquid crystal panel 80 in the processes described above, the user opens the front cover 3 to take the appropriate steps regarding the consumption state or drive state of the various components in the laser printer 1. A cover open process executed by the CPU 101 at this time will be described with reference to FIG. 16.

Figure 16:
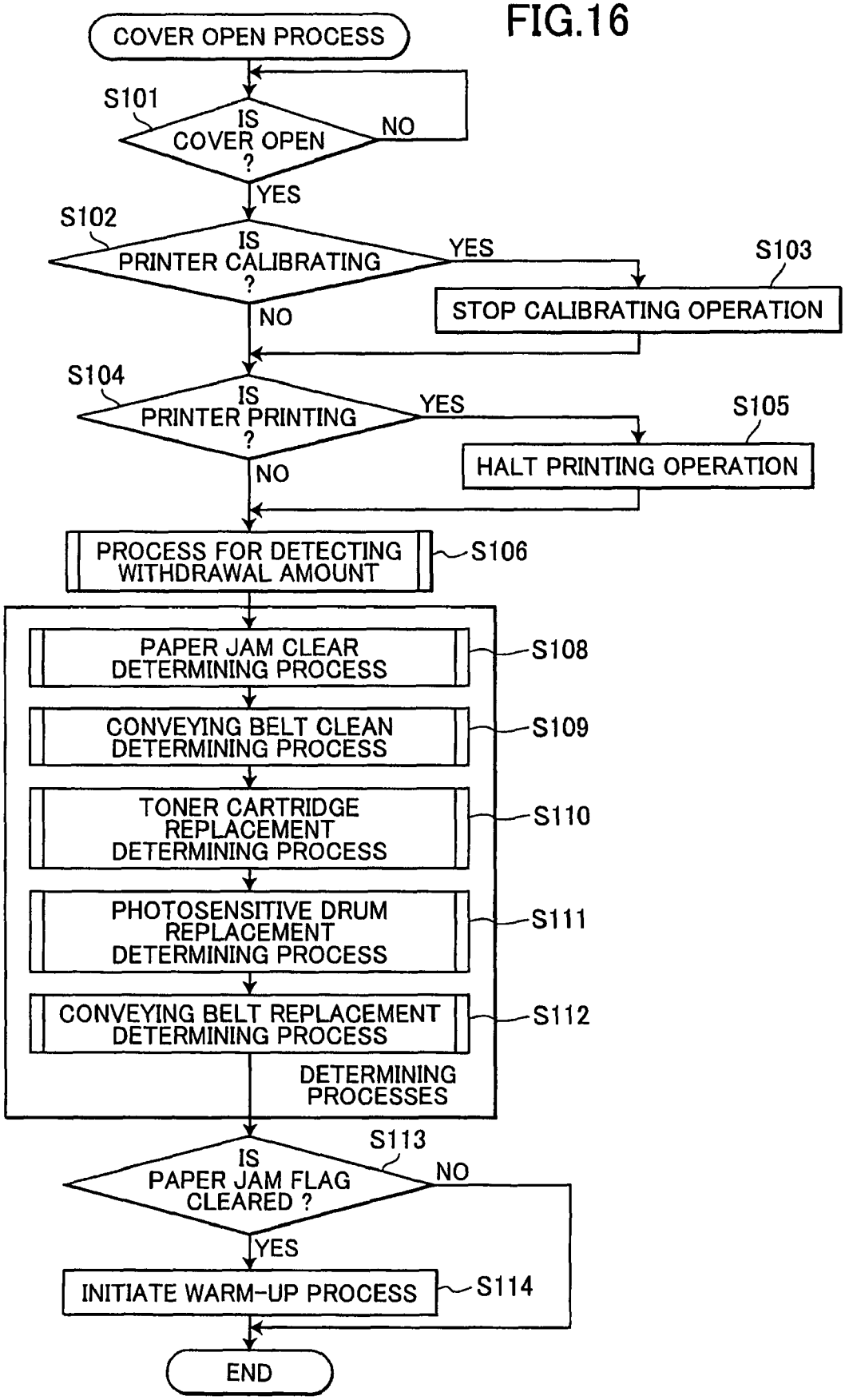
FIG. 16 is a flowchart representing a cover open process.

In S101 of FIG. 16, the CPU 101 executes the determination program 112 to determine whether the cover open sensor 49 has detected the front cover 3 being opened. The process of S101 is repeated as long as the opening of the front cover 3 is not detected (S101: NO). When the front cover 3 is detected to be open (S101: YES), in S102 the CPU 101 determines whether the laser printer 1 is executing a calibrating operation. In the calibrating operation, the laser printer 1 forms patches on the conveying belt 18 using each of the toner cartridges 34 and reads the patches with a density sensor (not shown) in order to detect and calibrate the density of images formed by the toner cartridges 34.

If the laser printer 1 is currently not executing the calibrating operation (S102: NO), the CPU 101 advances to S104. However, if the laser printer 1 is performing the calibrating operation (S102: YFS), then in S103, the CPU 101 halts the calibrating operation prior to advancing to S104. In S104, the CPU 101 determines whether the laser printer 1 is performing an image-forming operation. If not (S104: NO), the CPU 101 advances to S106 However, if so (S104: YES), then in S105, the CPU 101 stops the motor drive circuit 91 from driving the various motors 90 in order to halt the image-forming operation. Subsequently, the CPU 101 advances to S106. In S106, the CPU 101 executes a withdrawal amount detection process described later for detecting the amount in which the process unit 25 has been withdrawn from the main casing 2. Then, the CPU 101 performs, in S108 to S112, various determination processes described later. These determination processes include the following processes executed in the order given: a paper-jam clear determining process (S108), a conveying-belt clean determining process (S109), a toner-cartridge replacement determining process (s110), a photosensitive-drum replacement determining process (S111), and a conveying-belt replacement determining process (S112). After completing the conveying-belt replacement determining process in S112, the CPU 101 determines in S113 whether the paper jam flag has been cleared. If the paper jam flag is set (S113: NO), the process ends. However, if the paper jam flag has been cleared (S113: YES), then in S114, the CPU 101 initiates a warm-up process. Subsequently, the process ends.

Next, the withdrawal amount detection process executed in S106 will be described with reference to FIGS. 8(*a*) to 8(*e*) and 17.

At the beginning of the withdrawal amount detection process shown in FIG. 17, in S1001, the CPU 101 clears the continuous withdrawn counter 70A and the maximum continuous withdrawn counter 70B. Here, the continuous withdrawn counter 70A measures the time in which each of the toner cartridges 34A to 35D has been continuously withdrawn from the main casing 2. The maximum continuous withdrawn counter 70B functions to measure the maximum length of time in which each of the toner cartridges 34A to 34D has been continuously withdrawn from the main casing 2 during a period that the front cover 3 is opened and closed.

Then in S1002, the CPU 101 executes the determination program 112 to determine whether the fourth out-of-toner sensor 35A was turned ON. If the CPU 101 determines that the fourth out-of-toner sensor 35A was turned ON (S1002: YES), the CPU 101 determines that the process unit 25 was withdrawn to a position for replacing the first toner cartridge 34A (see FIG. 8(*b*)) and increments the continuous withdrawal count for the first toner cartridge 34A in S1003. In S1004, the CPU 101 determines whether the third out-of-toner sensor 35B turned ON. If the CPU 101 determines that the out-of-toner sensor 35B was turned ON (S1004: YES), then the CPU 101 determines that the process unit 25 was withdrawn to a position for replacing the first and second toner cartridges 34A and 34B (see FIG. 8(*c*)), and the CPU 101 increments the continuous withdrawal count for both the toner cartridges 34A and 34B in S1005. In S1006, the CPU 101 determines whether the second out-of-toner sensor 35C was turned ON. If the CPU 101 determines that the second out-of-toner sensor 35C was turned ON (S1006: YES), then the CPU 101 determines that the process unit 25 was withdrawn to a position for replacing the first to third toner cartridges 34A to 34C (see FIG. 8(*d*)), and the CPU 101 increments the continuous withdrawal count for all the first to third toner cartridges 34A to 34C in S1007. In S1008, the CPU 101 determines whether the first out-of-toner sensor 35D was turned ON. If the CPU 101 determines that the first out-of-toner sensor 35D was turned ON (S1008: YES), then the CPU 101 determines that the process unit 25 was withdrawn to a position for replacing all the toner cartridges 34A to 34D (see FIG. 8(*e*)), and the CPU 101 increments the continuous withdrawal count for all the toner cartridges 34A to 34D in S1009. The CPU 101 repeats the determining process in S100B and the incrementing process in S1009 until determining that the first out-of-toner sensor 35D has turned OFF (S1008: NO).

If the CPU 101 determines in S1002 that the fourth out-of-toner sensor 35A is not ON (S1002: NO), then in S1010 the CPU 101 determines whether the continuous withdrawal count is greater than the maximum continuous withdrawal count for the first toner cartridge 34A. If not (S1010: NO), then the CPU 101 proceeds to S1012. On the other hand, if so (S1010: YES), then in S1011, the CPU 101 sets the maximum continuous withdrawal count in the maximum continuous withdrawn counter 70B for the first toner cartridge 34A to this continuous withdrawal count for the first toner cartridge 34A, and proceeds to S1012. In S1012, the CPU 101 clears the continuous withdrawal count for the first toner cartridge 34A and proceeds to S1022.

If the CPU 101 determines in S1004 that the third out-of-toner sensor 35B is not ON (S1004: NO), then in S1013, the CPU 101 determines whether the continuous withdrawal count is greater than the maximum continuous withdrawal count for the second toner cartridge 34B. If not (S1013: NO), then, the CPU 101 proceeds to S1015. On the other hand, if so (S1013: YES), then in S1014, the CPU 101 sets the maximum continuous withdrawal count in the maximum continuous withdrawn counter 70B to this continuous withdrawal count for the second toner cartridge 34B, and proceeds to S1015. In S1015, the CPU 101 clears the continuous withdrawal count for the second toner cartridge 34B and proceeds to S1022.

If the CPU 101 determines in S1006 that the second out-of-toner sensor 35C is not ON (S1006: NO), then in S1016, the CPU 101 determines whether the continuous withdrawal count is greater than the maximum continuous withdrawal count for the third toner cartridge 34C If not (S1016: NO), then, the CPU 101 proceeds to S1018. On the other hand, if so (S1016: YES), then in S1017, the CPU 101 sets the maximum continuous withdrawal count in the maximum continuous withdrawn counter 70B to this continuous withdrawal count for the third toner cartridge 34C, and proceeds to S1018. In S1018, the CPU 101 clears the continuous withdrawal count for the third toner cartridge 34C and proceeds to S1022.

If the CPU 101 determines in S1008 that the first out-of-toner sensor 35D is not ON (S1008: NO), then in S1019, the CPU 101 determines whether the continuous withdrawal count is greater than the maximum continuous withdrawal count for the fourth toner cartridge 34D. If not (S1019: NO), then, the CPU 101 proceeds to S1021. On the other hand, if so (S1019: YES), then in S1020, the CPU 101 sets the maximum continuous withdrawal count in the maximum continuous withdrawn counter 70B to this continuous withdrawal count for the fourth toner cartridge 34D, and proceeds to S1021. In S1021, the CPU 101 clears the continuous withdrawal count for the fourth toner cartridge 34D and proceeds to S1022.

In S1022, the CPU 101 determines whether or not the cover open sensor 49 has detected the front cover 3 being closed. If not (S1022: NO), then the CPU 101 returns to S1002. On the other hand, if so (S1022: YES), then the process ends.

By performing the withdrawal amount detection process described above, it is possible to detect the maximum length of time that each of the toner cartridges 34A to 34D has been continuously withdrawn from the main casing 2 while the front cover 3 of the laser printer 1 is open.

Figure 18:
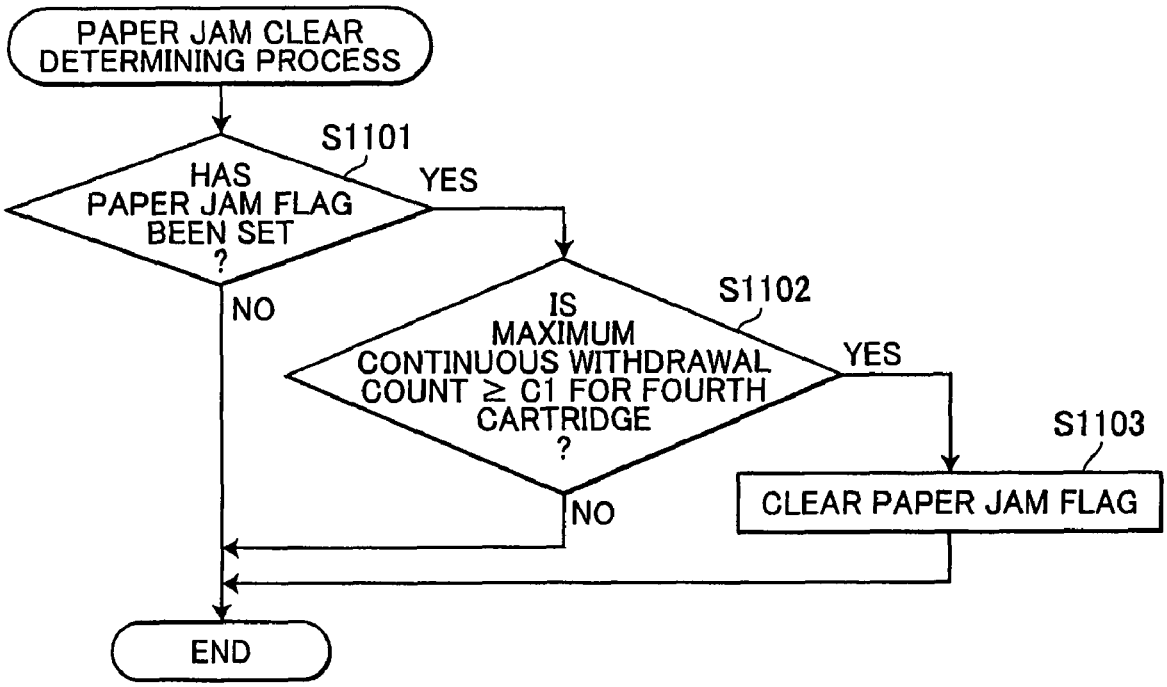
FIG. 18 is a flowchart representing a paper-jam clear determining process.

Next, the paper-jam clear determining process of S108 in FIG. 16 will be described with reference to FIG. 18. This process functions to determine whether a paper jam occurring on the paper-conveying path 6 between the post-registration sensor 28A and the discharge sensor 28B has been resolved.

In S1101 of this process, the CPU 101 determines whether the paper jam flag was set in the paper-jam clear displaying process of FIG. 12. If not (S1101: NO), the CPU 101 determines that a paper jam did not occur and ends the process. On the other hand, if so (S1101: YES), then in S1102, the CPU 101 determines whether the maximum continuous withdrawal count for the fourth toner cartridge 34D is greater than or equal to a prescribed value $C_1$. If so (S1102: YES), then the CPU 101 determines that the process unit 25 was withdrawn the maximum amount from the main casing 2 for a period of time required to access the paper-conveying path 6 via the opening 2A and remove the jammed paper 4 and, hence, clears the paper jam flag in S1103. Subsequently, the process ends. However, if the CPU 101 determines that the maximum continuous withdrawal count for the toner cartridge 34D is less than the prescribed value $C_1$ (S1102; NO), then the CPU 101 determines that the process unit 25 was not withdrawn from the main casing 2 the maximum amount for a sufficient amount of time to resolve the paper jam, and ends the process without clearing the paper jam flag.

In this way, the CPU 101 can determine whether the process unit 25 was withdrawn the maximum amount for a sufficient time to resolve a paper jam.

Here, the prescribed value $C_1$ and prescribed values $C_2$-$C_5$ described later are determined with consideration for the structure of the laser printer 1 and the like. For example, since the process unit 25 must be withdrawn to a position for replacing the toner cartridge 34A for a continuous time of 5 seconds or more in order to remove the nearest toner cartridge 34A from the unit-accommodating section 50 and mount a new toner cartridge 34, the prescribed value $C_3$ is set to a value corresponding to this time. More specifically, if the maximum continuous withdrawn counter 70B is incremented every 100 msec, the prescribed value $C_3$ is set to 5 sec/100 msec=50.

Figure 19:
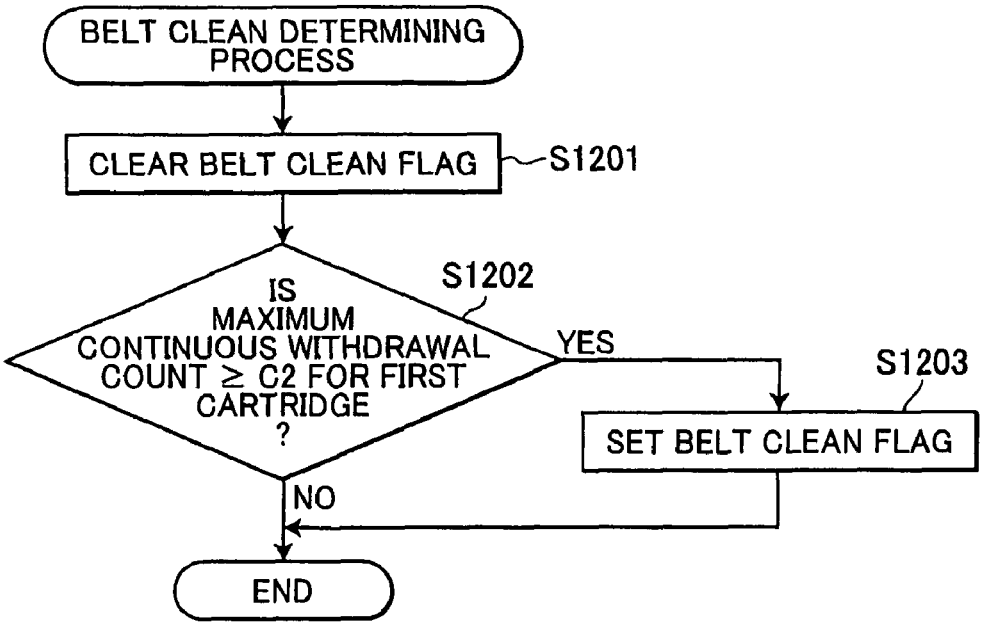
FIG. 19 is a flowchart representing a belt clean determining process.

Next, the conveying belt clean determining process executed in S109 of FIG. 16 will be described with reference to FIG. 19. This process functions to determine whether the cleaning unit 20 needs to clean the conveying belt 18.

In S1201, the CPU 101 clears a belt clean flag. In S1202, the CPU 101 determines whether the maximum continuous withdrawal count for the first toner cartridge 34A is greater than or equal to a prescribed value $C_2$. If so (S1202: YES), the CPU 101 determines that the process unit 25 has been withdrawn from the main casing 2 a certain amount of time for necessitating the cleaning of the conveying belt 18, and in S1203, sets the belt clean flag. Subsequently, the process ends. On the other hand, if not (S1202: NO), the CPU 101 determines that the process unit 25 has not been withdrawn from the main casing 2 a certain amount of time for necessitating the cleaning of the conveying belt 18, and ends the process without setting the belt clean flag.

In this way, the CPU 101 can determine whether the process unit 25 has been withdrawn from the main casing 2 a certain amount of time for necessitating the cleaning of the conveying belt 18.

Next, the toner-cartridge replacement determining process performed in S110 of FIG. 16 will be described with reference to FIG. 20. This process functions to determine whether each of the toner cartridges 34A to 34D has been replaced with a new toner cartridge.

In S1301 of the toner-cartridge replacement determining process, the CPU 101 clears a new/old identification flag for each of the toner cartridges 34A to 34D. In S1302, the CPU 101 determines whether the maximum continuous withdrawal count set in the maximum continuous withdrawn counter 70B for the toner cartridge 34A, which was measured during the withdrawal amount detection process in FIG. 17, is greater than or equal to the prescribed value $C_3$. If so (S1302: YES), then the CPU 101 determines that the process unit 25 was withdrawn from the main casing 2 for a sufficient time to replace the old toner cartridge 34A with a new toner cartridge 34A, and in S1303 sets the new/old identification flag for the toner cartridge 34A.

In S1304, the CPU 101 determines whether the maximum continuous withdrawal count set in the maximum continuous withdrawn counter 70B for the second toner cartridge 34B is greater than or equal to the prescribed value $C_3$. If so (S1304: YES), then the CPU 101 determines that the process unit 25 was withdrawn from the main casing 2 for a sufficient time to replace the old toner cartridge 34B with a new toner cartridge 34B, and in S1305, sets the new/old identification flag for the toner cartridge 34B.

In S1306, the CPU 101 determines whether the maximum continuous withdrawal count set in the maximum continuous withdrawn counter 70B for the third toner cartridge 34C is greater than or equal to the prescribed value $C_3$. If so (S1306: YES), then the CPU 101 determines that the process unit 25 was withdrawn from the main casing 2 for a sufficient time to replace the old toner cartridge 34C with a new toner cartridge 34C, and in S1307, sets the new/old identification flag for the toner cartridge 34C.

In S1308, the CPU 101 determines whether the maximum continuous withdrawal count set in the maximum continuous withdrawn counter 70B for the fourth toner cartridge 34D is greater than or equal to the prescribed value $C_3$. If so (S1308: YES), then the CPU 101 determines that the process unit 25 was withdrawn from the main casing 2 for a sufficient time to replace the old toner cartridge 34D with a new toner cartridge 34D, and in S1309, sets the new/old identification flag for the toner cartridge 34D. Then, the process ends.

However, if the CPU 101 determines that the maximum continuous withdrawal count value for the toner cartridge 34 is smaller than the prescribed value $C_3$ (S1302: NO, S1304: NO, S1306: NO, or S1308: NO), then the CPU 101 determines that the process unit 25 was not withdrawn from the main casing 2 for a sufficient time to replace the old toner cartridge 34 with a new toner cartridge 34, and ends the process.

In this way, the CPU 101 can determine whether the process unit 25 was withdrawn from the main casing 2 for a sufficient time required to replace an old toner cartridge 34 with a new toner cartridge 34.

Figure 21:
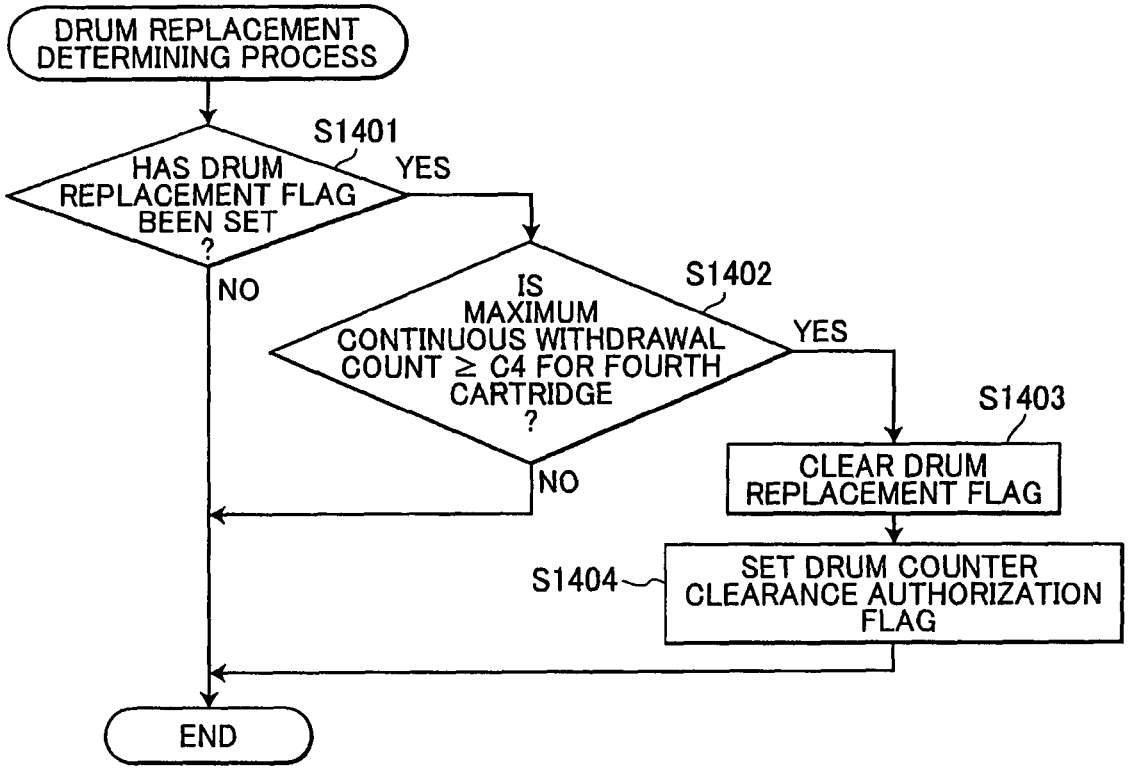
FIG. 21 is a flowchart representing a drum replacement determining process.

Next, the photosensitive-drum replacement determining process performed in S111 of FIG. 16 will be described with reference to FIG. 21. This process functions to determine whether old photosensitive drums 31 were replaced with new photosensitive drums 31.

In S1401, the CPU 101 determines whether the drum replacement flag has been set in the photosensitive-drum replacement displaying process in FIG. 14. If not (S1401: NO), the CPU 101 determines that the photosensitive drums 31 have not reached the end of their life and ends the process. On the other hand, if so (S1401: YES), then in S1402, the CPU 101 determines whether the maximum continuous withdrawal count for the fourth toner cartridge 34D is greater than or equal to a prescribed value $C_4$. If so (S1402: YES), then the CPU 101 determines that the process unit 25 has been withdrawn from the main casing 2 the maximum amount for a period sufficient to replace the four photosensitive drums 31 with new photosensitive drums 31, and in S1403, clears the drum replacement flag. In S1404, the CPU 101 sets a drum counter clearance authorization flag for allowing the drum counter 72 to be cleared and subsequently ends the process. However, if a negative determination is made in S1402 (S1402: NO), then the CPU 101 determines that the process unit 25 was not withdrawn the maximum amount for a period sufficient to replace the four photosensitive drums 31 with new photosensitive drums 31. Accordingly, the CPU 101 ends the process without clearing the drum replacement flag.

In this way, the CPU 101 can determine whether the process unit 25 has been withdrawn from the main casing 2 the maximum amount for a time period sufficient for replacing the four photosensitive drums 31 with new photosensitive drums 31.

Next, the belt-replacement determining process performed in S112 of FIG. 16 will be described with reference to FIG. 22. This process functions to determine whether an old conveying belt 18 was replaced with a new conveying belt 18.

In S1501, the CPU 101 determines whether the belt-replacement flag has been set in the conveying-belt replacement displaying process in FIG. 15. If not (S1501: NO), the CPU 101 determines that the conveying belt 18 has not reached the end of its life and ends the process. On the other hand, if so (S1501: YES), then in S1502, the CPU 101 determines whether the maximum continuous withdrawal count for the fourth toner cartridge 34D is greater than or equal to a prescribed value $C_5$. If so (S1502: YES), then the CPU 101 determines that the process unit 25 has been withdrawn from the main casing 2 the maximum amount for a period sufficient to replace the conveying belt 18 with a new conveying belt 18, and in S1503, clears the belt-replacement flag. In S1504, the CPU 101 sets a belt counter clearance authorization flag for allowing the belt counter 71 to be cleared and subsequently ends the process. However, if a negative determination is made in S1502 (S1502: NO), then the CPU 101 determines that the process unit 25 was not withdrawn the maximum amount for a period sufficient to replace the conveying belt 18 with a new conveying belt 18. Accordingly, the CPU 101 ends the process without clearing the belt-replacement flag.

In this way, the CPU 101 can determine whether the process unit 25 has been withdrawn from the main casing 2 the maximum amount for a time period sufficient for replacing the conveying belt 18 with a new conveying belt 18.

Figure 23:
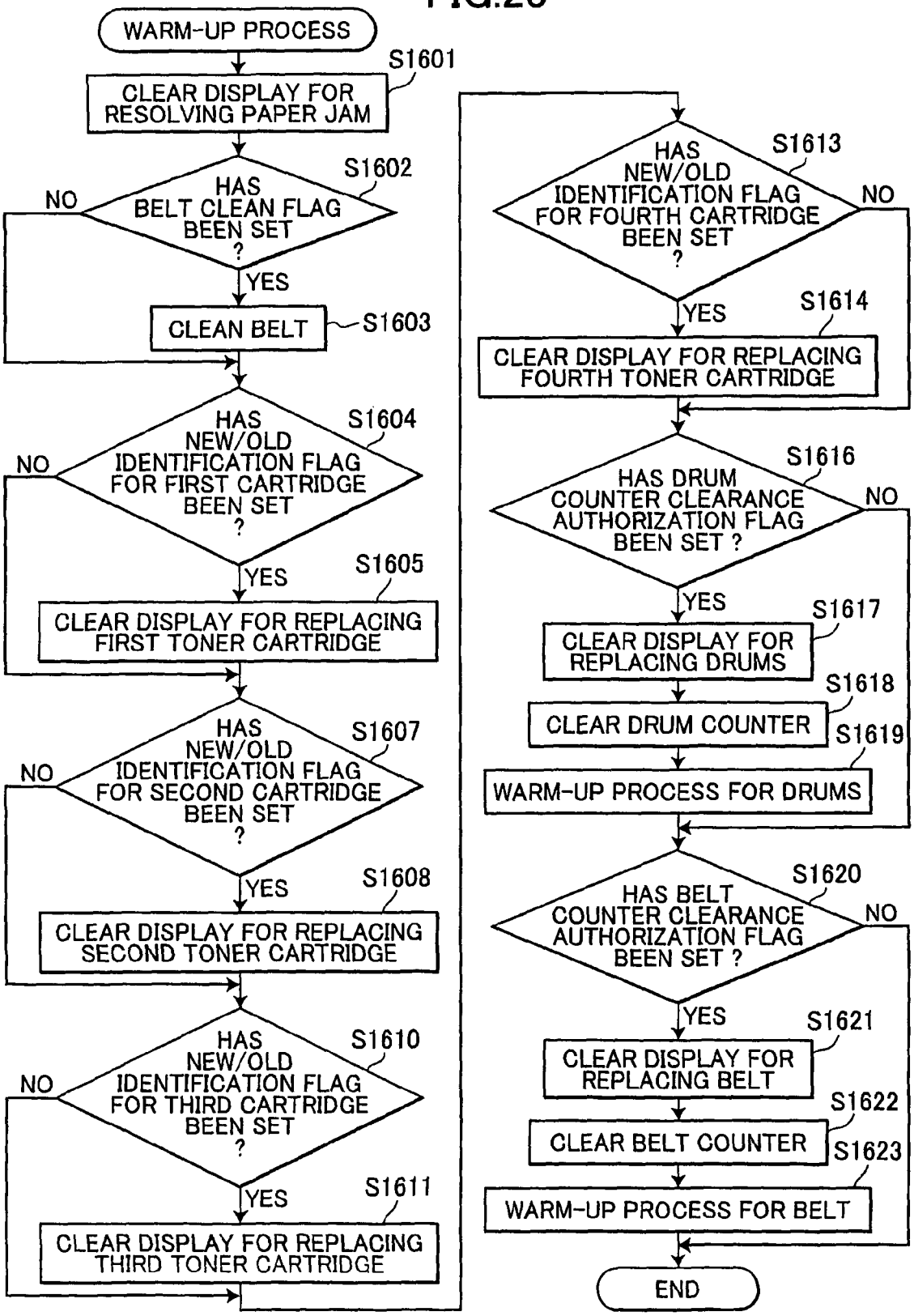
FIG. 23 is a flowchart representing a warm-up process.

Next, the warm-up process initiated in S114 of FIG. 16 will be described with reference to FIG. 23. The warm-up process is performed to confirm the consumption state and drive state of each of the components in the laser printer 1 or to ready the components for an image-forming operation.

Since the warm-up process is executed only if the CPU 101 has determined that the paper jam flag has been cleared in the cover open process of FIG. 16, the CPU 101 has determined that the user has removed the paper 4 from the section of the paper-conveying path 6 between the post-registration sensor 28A and the discharge sensor 28B, thereby resolving the paper jam. Hence, in S1601, the CPU 101 executes the clear display program 113 to clear the display on the liquid crystal panel 80 prompting the user to resolve the paper jam. In S1602, the CPU 101 determines whether the belt clean flag has been set in the conveying belt clean determining process of FIG. 19.

If the belt clean flag is not set (S1602: NO), then the CPU 101 advances to S1604. However, if the belt clean flag is set (S1602: YES), then in S1603, the CPU 101 controls the cleaning unit 20 to clean the conveying belt 18 and subsequently advances to S1604.

Figure 20:
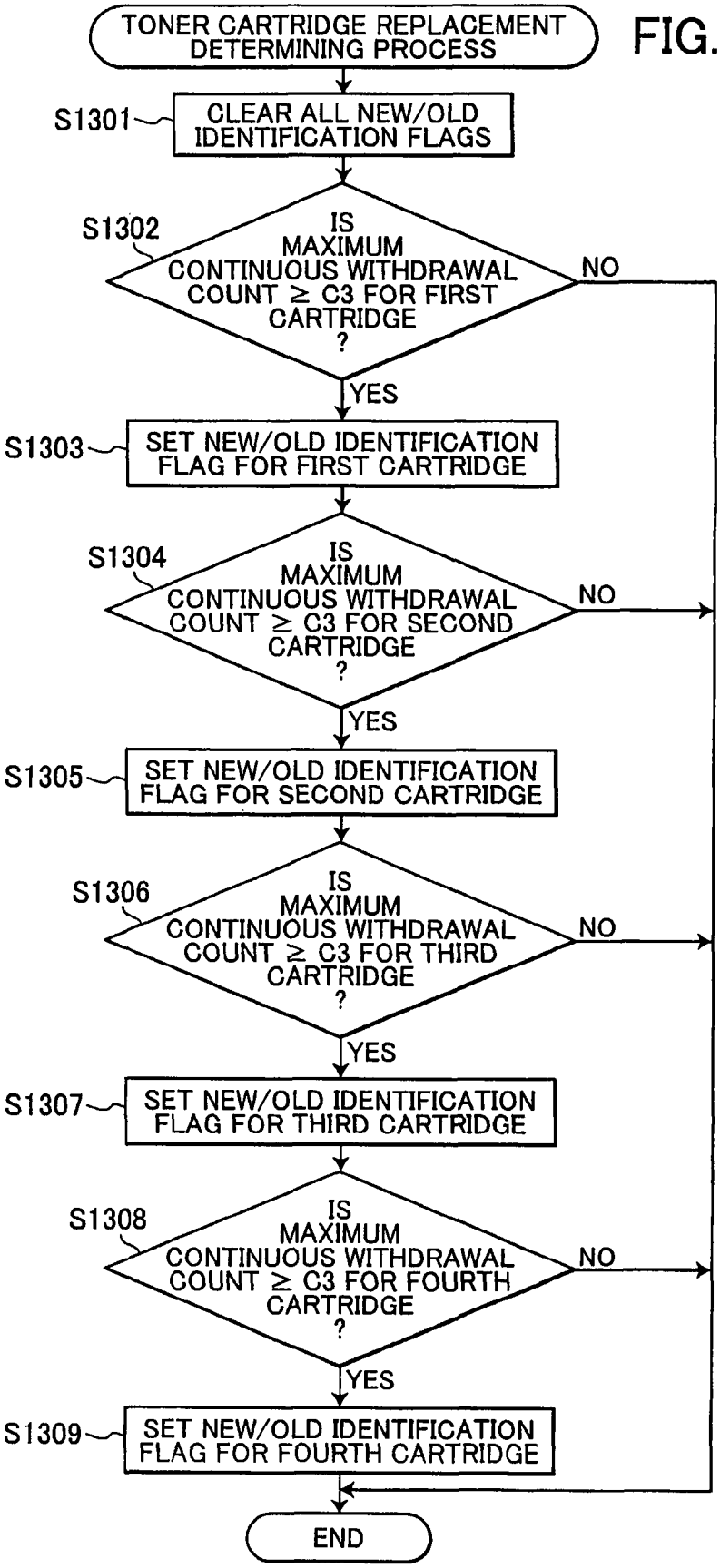
FIG. 20 is a flowchart representing a toner-cartridge replacement determining process.

In S1604, the CPU 101 determines whether the new/old identification flag has been set for the first toner cartridge 34A in the toner-cartridge replacement determining process of FIG. 20. If the CPU 101 determines that the new/old identification flag is set (S1604: YES), then the CPU 101 determines that the toner cartridge 34A has been replaced with a new toner cartridge 34A. Accordingly, in S1605, the CPU 101 executes the clear display program 113 to clear the display on the liquid crystal panel 80 prompting the user to replace the toner cartridge 34A, and advances to S1607. On the other hand, if the CPU 101 determines that the new/old identification flag has not been set for the first toner cartridge 34A (S1604: NO), then the CPU 101 determines that the empty toner cartridge 34A has not yet been replaced with a new toner cartridge 34A. Accordingly, the CPU 101 skips the process in S1605 and advances to S1607.

In S1607, the CPU 101 determines whether the new/old identification flag has been set for the second toner cartridge 34B. If the CPU 101 determines that the new/old identification flag is set (S1607: YES), then the CPU 101 determines that the second toner cartridge 34B has been replaced with a new toner cartridge 34B. Accordingly, in S1608, the CPU 101 executes the clear display program 113 to clear the display on the liquid crystal panel 80 prompting the user to replace the toner cartridge 34B, and then proceeds to S1610. On the other hand, if the CPU 101 determines in S1607 that the new/old identification flag has not been set for the second toner cartridge 34B (S1607: NO), then the CPU 101 determines that the empty toner cartridge 34B has not yet been replaced with a new toner cartridge 34B Accordingly, the CPU 101 skips the process in S1608 and advances to S1610.

In S1610, the CPU 101 determines whether the new/old identification flag has been set for the third toner cartridge 34C. If the CPU 101 determines that the new/old identification flag is set (s1610: YES), then the CPU 101 determines that the third toner cartridge 3C has been replaced with a new toner cartridge 34C. Accordingly, in S1611, the CPU 101 executes the clear display program 113 to clear the display on the liquid crystal panel 80 prompting the user to replace the toner cartridge 34C, and then proceeds to S1613 On the other hand, if the CPU 101 determines in S1610 that the new/old identification flag has not been set (S1610: NO), then the CPU 101 determines that the empty toner cartridge 34C has not yet been replaced with a new toner cartridge 34D. Accordingly, the CPU 101 skips the process in S1611 and advances to S1613

In S1613, the CPU 101 determines whether the new/old identification flag has been set for the fourth toner cartridge 34D. If the CPU 101 determines that the new/old identification flag is set (S113: YES), then the CPU 101 determines that the fourth toner cartridge 34D has been replaced with a new toner cartridge 34D. Accordingly, in S1614, the CPU 101 executes the clear display program 113 to clear the display on the liquid crystal panel 80 prompting the user to replace the toner cartridge 34D, and then proceeds to S1616. On the other hand, if the CPU 101 determines in S1613 that the new/old identification flag has not been set (S1613: NO), then the CPU 101 determines that the empty toner cartridge 34D has not yet been replaced with a new toner cartridge 34D. Accordingly, the CPU 101 skips the process in S1614 and advances to S1616.

In S1616, it is determined whether or not the drum counter clearance authorization flag has been set. If the CPU 101 determines in S1616 that the drum counter clearance authorization flag has been set (S1616: YES), then the CPU 101 determines that the four photosensitive drums 31 have been removed from the unit-accommodating section 50 and replaced with new photosensitive drums 31. Accordingly, in S1617, the CPU 101 executes the clear display program 113 to clear the display on the liquid crystal panel 80 prompting the user to replace the photosensitive drums 31. In S1618, the CPU 101 clears the count value of the drum counter 72, and in S1619, executes a warm-up process for the photosensitive drums 31. After completing the warm-up process, the CPU 101 proceeds to S1620. However, if the CPU 101 determines that the drum counter clearance authorization flag has not been set (S1616: NO), then the CPU 101 determines that the four photosensitive drums 31 have not yet been replaced with new photosensitive drums 31. Accordingly, the CPU 101 skips the processes of S1617-S1619 and proceeds to S1620.

Figure 22:
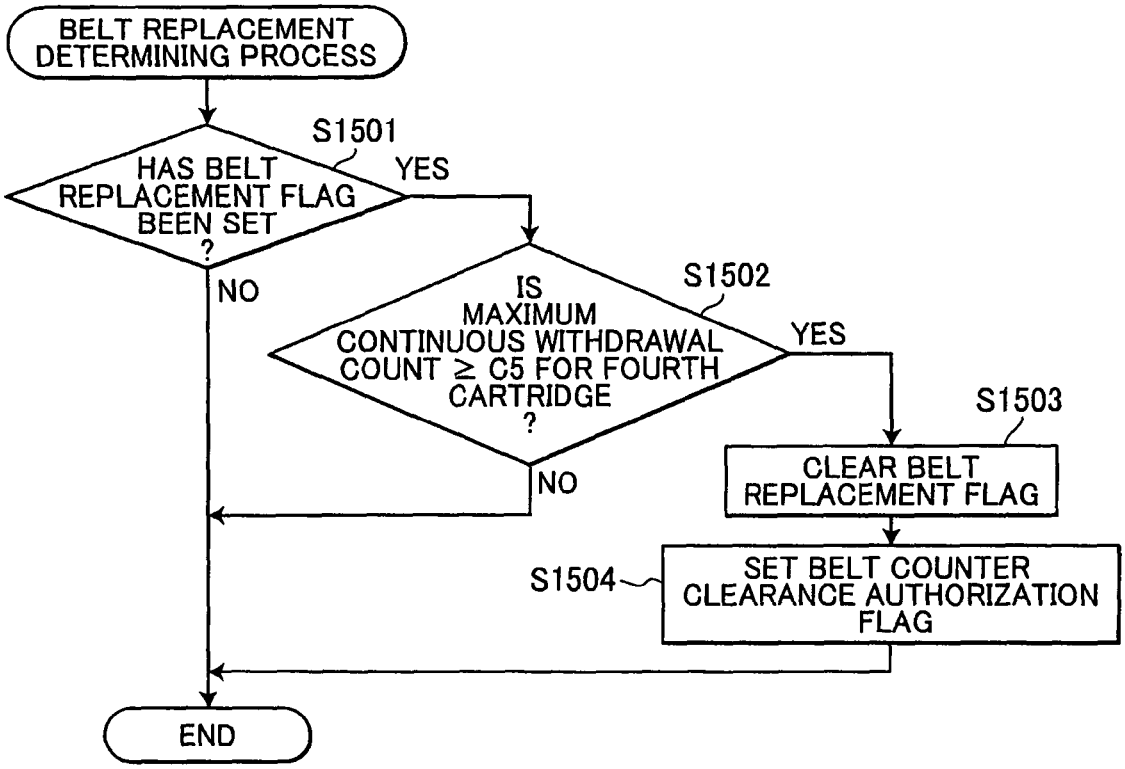
FIG. 22 is a flowchart representing a belt replacement determining process.

In S1620, the CPU 101 determines whether the belt counter clearance authorization flag has been set in the conveying-belt replacement determining process of FIG. 22 If so (S1620: YES), then the CPU 101 determines that the conveying belt 18 has been removed from the unit-accommodating section 50 and replaced with a new conveying belt 18. Accordingly, in S1621, the CPU 101 executes the clear display program 113 to clear the display on the liquid crystal panel 80 prompting the user to replace the conveying belt 18. In S1622, the CPU 101 clears the count value of the belt counter 71, and in S1623, executes a warm-up process for the conveying belt 18. After completing the warm-up process, the process ends. On the other hand, if the CPU 101 determines in S1620 that the belt counter clearance authorization flag has not been set (S1662: NO), then the CPU 101 determines that the conveying belt 18 has not yet been replaced with a new conveying belt 18. Accordingly, the CPU 101 skips the processes of S1621-S1623, and the process ends.

As described above, the four out-of-toner sensors 35 can detect the withdrawal amount of the process unit 25. Based on this withdrawal amount, it is possible to measure the length of continuous time in which the process unit 25 has been withdrawn from the main casing 2. This construction has the following effects.

(1) Since the withdrawal amount of the process unit 25 can be detected with the four out-of-toner sensors 35, a special detecting means for detecting this withdrawal amount is not necessary, thereby contributing to a reduced manufacturing cost. Further, by detecting the withdrawal amount of the process unit 25, it is possible to detect the withdrawal amount required for maintenance on the laser printer 1, such as replacing the toner cartridges 34, removing paper 4 jammed in the paper-conveying path 6, replacing the photosensitive drums 31, replacing the conveying belt 18, and necessitating cleaning of the conveying belt 18.

(2) The laser printer 1 can determine that the toner cartridge 34 has not been replaced if the process unit 25 was not withdrawn for a sufficient amount of time for replacing the toner cartridge 34; for example, if the user performed an operation to withdraw the process unit 25 to a position in which the toner cartridge 34 could be removed, but the process unit 25 was reinserted into the main casing 2 immediately. Accordingly, the laser printer 1 can display a message for replacing the toner cartridge 34 and clear the display at a more suitable timing. Further, this construction can reduce the number of unnecessary operations performed for detecting the amount of remaining toner the toner cartridge was actually not replaced.

(3) The laser printer 1 can determine that the paper jam has not been resolved if the process unit 25 was not withdrawn a sufficient length of time for removing the paper 4 from the paper-conveying path 6; for example, if the process unit 25 was withdrawn to a position at which the user could access the paper-conveying path 6 via the opening 2A, but was immediately reinserted into the main casing 2. Accordingly, the laser printer 1 can display a message prompting the user to remove the paper 4 and clear the message at a more suitable timing.

(4) The laser printer 1 can determine that the photosensitive drums 31 were not replaced if the process unit 25 was not withdrawn a sufficient amount of time required for replacing the photosensitive drums 31; for example, if the process unit 25 was withdrawn to a position for replacing the photosensitive drums 31 but was immediately reinserted into the main casing 2. Accordingly, the laser printer 1 can display a message prompting the user to replace the photosensitive drums 31 and can clear the display at a more suitable timing. Further, this construction can reduce cases in which the counter value of the drum counter 72 is reset even though the photosensitive drums 31 have not actually been replaced.

(5) The laser printer 1 can determine that the conveying belt 18 was not replaced if the process unit 25 was not withdrawn a sufficient amount of time required for replacing the conveying belt 18; for example, if the process unit 25 was withdrawn to a position for replacing the conveying belt 18 but was immediately reinserted into the main casing 2. Accordingly, the laser printer 1 can display a message prompting the user to replace the conveying belt 18 and can clear the display at a more suitable timing. Further, this construction can reduce cases in which the counter value of the belt counter 71 is reset even though the conveying belt 18 have not actually been replaced.

(6) The laser printer 1 can determine that it is unnecessary to clean the conveying belt 18 if the process unit 25 was not withdrawn a certain amount of time for necessitating the cleaning of the conveying belt 18; for example, if the process unit 25 was withdrawn to a certain position but was immediately reinserted into the main casing 2. Accordingly, the laser printer 1 can clean the conveying belt 18 at a more suitable timing.

While the invention has been described in detail with reference to the above aspects thereof, it would be apparent to those skilled in the art that various changes and modifications may be made therein without departing from the spirit of the invention.

For example, the above-described laser printer 1 employs toner in the colors yellow, magenta, cyan, and black. However, the invention may also be applied to printers using only two colors of toner, such as red and black, and printers using six colors of toner. In such cases, the number of out-of-toner sensors 35 provided in the printer corresponds to the number of colors of toner used.

According to the above-described laser printer 1, a message prompting the user to perform maintenance on the laser printer 1 is displayed on the liquid crystal panel 80. However, the user may be prompted to perform such maintenance by lighting LED lamps, generating beeping sounds, or the like.

In addition to displaying a message on the liquid crystal panel 30 prompting the user to perform maintenance when the toner cartridge 34 runs out of toner, the photosensitive drums 31 reach the end of their life, or the conveying belt 18 reaches the end of its life, it is also possible to immediately halt the image-forming operation performed on the laser printer 1.

According to the above-described laser printer 1, the withdrawal amount of the process unit 25 is used to detect a timing for replacing or cleaning the conveying belt 18. However, the withdrawal amount of the process unit 25 may also be used to detect the timing for replacing or cleaning an intermediate transfer belt (not shown), which is used to temporarily hold toner images formed on the photosensitive drums 31 and to transfer those images onto the paper 4.

What is claimed is:

1. A color image-forming device comprising:

a plurality of developer cartridges, each accommodating developer and having a pair of windows;

a drawer section that accommodates the developer cartridges in a linearly juxtaposed relationship;

a casing that accommodates the drawer section, wherein the drawer section is configured to be withdrawn from the casing in a direction that the developer cartridges are juxtaposed;

a plurality of sensors that corresponds to the plurality of developer cartridges, each of the sensors having a light-emitting unit that emits a-light and a light-receiving unit that receives the light emitted from the light-emitting unit, the light-emitting unit and the light-receiving unit being disposed one on either side of the windows of a corresponding one of the developer cartridges accommodated in the drawer section when the drawer section is accommodated in the casing;

a toner-amount detecting unit that detects the amount of developer remaining in each of the developer cartridges based on detection results of the sensors; and a withdrawal-amount determining unit that determines a withdrawal amount in which the drawer section was withdrawn from the casing based on a combination of detection results of the plurality of sensors.

2. The color image-forming device according to claim 1, further comprising:

a notifying unit that issues a notification to remove an object from the casing; and a notification clearing unit that clears the notification when the withdrawal-amount determining unit determines that the drawer section was withdrawn from the casing to a position at which the object could be removed.

3. The color image-forming device according to claim 2, further comprising a time-keeping unit that measures a duration of withdrawal time in which the drawer section was withdrawn from the casing to the position at which the object could be removed, wherein the notification clearing unit clears the notification when the duration of withdrawal time measured by the time-keeping unit is equal to or greater than a prescribed time.

4. The color image-forming device according to claim 2, wherein: the toner-amount detecting unit determines whether the amount of developer remaining in each of the developer cartridges is greater than a prescribed developer amount based on the detection results of the sensors; and when the toner-amount detecting unit determines that the amount of developer remaining in one-of the developer cartridges is not greater than the prescribed developer amount, the notifying unit issues a notification to replace the one of developer cartridges.

5. The color image-forming device according to claim 2, further comprising a conveying path along which a recording medium is conveyed, wherein:

the casing is formed with an opening that is exposed by withdrawing the drawer section from the casing for enabling a user to access the conveying path to remove the recording medium;

the notifying unit issues a notification to remove the recording medium in the conveying path; and the notification clearing unit clears the notification when the withdrawal-amount determining unit determines that the drawer section was withdrawn from the casing to a position allowing a user to access the conveying path.

6. The color image-forming device according to claim 2, wherein the developer cartridges include respective photosensitive members, and the object is the photosensitive members.

7. The color image-forming device according to claim 6, further comprising:

a first rotation counter that counts the number of rotations of the photosensitive members, wherein the notifying unit issues a notification to replace the photosensitive members when a counter value of the first rotation counter is greater than or equal to a prescribed rotation value, and a resetting unit that resets the counter value of the first rotation counter when the notification clearing unit clears the notification.

8. The color image-forming device according to claim 2, further comprising a conveying unit that conveys a recording medium, wherein:

the casing is formed with an opening that is exposed when the drawer section is withdrawn from the casing for allowing a user to access the conveying unit in order to replace the conveying unit;

the notifying unit issues a notification to replace the conveying unit; and the notification clearing unit clears the notification when the withdrawal-amount determining unit determines that the drawer section was withdrawn from the casing to a position allowing the user to access the conveying unit.

9. The color image-forming device according to claim 8, further comprising:

a second rotation counter that counts the number of rotations of the conveying unit, wherein the notifying unit issues the notification to replace the conveying unit when a counter value of the second rotation counter is greater than or equal to a prescribed rotation value, and a resetting unit that resets the counter value of the second rotation counter when the notification clearing unit clears the notification.

10. The color image-forming device according to claim 8, further comprising a cleaning unit that cleans the conveying unit when the withdrawal-amount determining unit determines that the drawer section was withdrawn from the casing to a position allowing the user to remove at least one of the developer cartridges from the drawer section.

* * * * *